US010646404B2

(12) United States Patent
Denenburg et al.

(10) Patent No.: US 10,646,404 B2
(45) Date of Patent: May 12, 2020

(54) DUAL VIAL ADAPTER ASSEMBLAGES INCLUDING IDENTICAL TWIN VIAL ADAPTERS

(71) Applicant: West Pharma. Services IL, Ltd., Ra'anana (IL)

(72) Inventors: Igor Denenburg, Gedera (IL); Amir Lev, Kfar Saba (IL); Uri David, Nes Ziona (IL)

(73) Assignee: West Pharma. Services IL, Ltd., Ra'anana (IL)

( * ) Notice: Subject to any disclaimer, the term of this patent is extended or adjusted under 35 U.S.C. 154(b) by 0 days.

(21) Appl. No.: 16/303,832

(22) PCT Filed: May 10, 2017

(86) PCT No.: PCT/IL2017/050514
§ 371 (c)(1),
(2) Date: Nov. 21, 2018

(87) PCT Pub. No.: WO2017/203511
PCT Pub. Date: Nov. 30, 2017

(65) Prior Publication Data

US 2019/0336394 A1 Nov. 7, 2019

(30) Foreign Application Priority Data

May 24, 2016 (IL) ..... 245800

(51) Int. Cl.
*A61J 1/20* (2006.01)
*A61J 1/14* (2006.01)

(52) U.S. Cl.
CPC ..... *A61J 1/2096* (2013.01); *A61J 1/1406* (2013.01); *A61J 1/2013* (2015.05); *A61J 1/2041* (2015.05);
(Continued)

(58) Field of Classification Search
CPC ..... A61J 1/2013; A61J 1/2041; A61J 1/2048; A61J 1/2075; A61J 1/2082; A61J 1/1406; A61J 1/2096; A61M 5/345
See application file for complete search history.

(56) References Cited

U.S. PATENT DOCUMENTS 62,333 A 2/1867 Holl
247,975 A 10/1881 Wickes
(Continued)

FOREIGN PATENT DOCUMENTS

CA 2946559 A1 10/2015
CN 1636605 A 7/2005
(Continued)

OTHER PUBLICATIONS

Novel Transfer, Mixing and Drug Delivery Systems, MOP Medimop Medical Projects Ltd. Catalog, 4 pages, Rev. 4, 2004.
(Continued)

*Primary Examiner* — Adam Marcetich
*Assistant Examiner* — Jessica R Arble
(74) *Attorney, Agent, or Firm* — Panitch Schwarze Belisario & Nadel LLP

(57) ABSTRACT

Dual vial adapter assemblages including two identical twin vial adapters each having an upright vial adapter connector of a first connector type and a dual ended liquid transfer coupler interdisposed between the two identical twin vial adapters and having a pair of opposite coupler ends in the form of twin connectors of a second connector type for sealed engagement with the vial adapter connectors of the first connector type.

4 Claims, 11 Drawing Sheets

(52) U.S. Cl.
CPC ..... *A61J 1/2048* (2015.05); *A61J 1/2075* (2015.05); *A61J 1/2082* (2015.05)

(56) References Cited

U.S. PATENT DOCUMENTS

| | | | |
|---|---|---|---|
| 254,444 | A | 2/1882 | Vogel |
| 300,060 | A | 6/1884 | Ford |
| 1,021,681 | A | 3/1912 | Jennings |
| 1,704,817 | A | 3/1929 | Ayers |
| 1,930,944 | A | 10/1933 | Schmitz, Jr. |
| 2,326,490 | A | 8/1943 | Perelson |
| 2,560,162 | A | 7/1951 | Garwood |
| 2,748,769 | A | 6/1956 | Huber |
| 2,830,587 | A | 4/1958 | Everett |
| 2,931,668 | A | 4/1960 | Baley |
| 2,968,497 | A | 1/1961 | Treleman |
| 3,059,643 | A | 10/1962 | Barton |
| D198,499 | S | 6/1964 | Harautuneian |
| 3,225,763 | A | 12/1965 | Waterman |
| 3,277,893 | A | 10/1966 | Clark |
| 3,308,822 | A | 3/1967 | De Luca |
| 3,484,849 | A | 12/1969 | Huebner et al. |
| 3,618,637 | A | 11/1971 | Santomieri |
| 3,757,981 | A | 9/1973 | Harris, Sr. et al. |
| 3,782,365 | A | 1/1974 | Pinna |
| 3,788,524 | A | 1/1974 | Davis et al. |
| 3,822,700 | A | 7/1974 | Pennington |
| 3,826,261 | A | 7/1974 | Killinger |
| 3,872,992 | A | 3/1975 | Larson |
| 3,885,607 | A | 5/1975 | Peltier |
| 3,938,520 | A | 2/1976 | Scislowicz et al. |
| 3,957,052 | A | 5/1976 | Topham |
| 3,977,555 | A | 8/1976 | Larson |
| 3,993,063 | A | 11/1976 | Larrabee |
| 4,020,839 | A | 5/1977 | Klapp |
| 4,026,128 | A | 5/1977 | Blanco |
| 4,051,852 | A | 10/1977 | Villari |
| D247,975 | S | 5/1978 | Luther |
| D248,568 | S | 7/1978 | Ismach |
| 4,109,670 | A | 8/1978 | Slagel |
| 4,121,585 | A | 10/1978 | Becker, Jr. |
| 4,161,178 | A | 7/1979 | Genese |
| 4,187,848 | A | 2/1980 | Taylor |
| D254,444 | S | 3/1980 | Levine |
| 4,203,067 | A | 5/1980 | Fitzky et al. |
| 4,203,443 | A | 5/1980 | Genese |
| 4,210,173 | A | 7/1980 | Choksi et al. |
| D257,286 | S | 10/1980 | Folkman |
| 4,253,501 | A | 3/1981 | Ogle |
| 4,296,786 | A | 10/1981 | Brignola |
| 4,303,067 | A | 12/1981 | Connolly et al. |
| 4,312,349 | A | 1/1982 | Cohen |
| 4,314,586 | A | 2/1982 | Folkman |
| 4,328,802 | A | 5/1982 | Curley et al. |
| 4,335,717 | A | 6/1982 | Bujan et al. |
| D267,199 | S | 12/1982 | Koenig |
| 4,376,634 | A | 3/1983 | Prior et al. |
| D268,871 | S | 5/1983 | Benham et al. |
| 4,392,850 | A | 7/1983 | Elias et al. |
| D270,282 | S | 8/1983 | Gross |
| 4,410,321 | A | 10/1983 | Pearson et al. |
| 4,411,662 | A | 10/1983 | Pearson |
| D271,421 | S | 11/1983 | Fetterman |
| 4,434,823 | A | 3/1984 | Hudspith |
| 4,465,471 | A | 8/1984 | Harris et al. |
| 4,475,915 | A | 10/1984 | Sloane |
| 4,493,348 | A | 1/1985 | Lemmons |
| 4,505,709 | A | 3/1985 | Froning et al. |
| 4,507,113 | A | 3/1985 | Dunlap |
| D280,018 | S | 8/1985 | Scott |
| 4,532,969 | A | 8/1985 | Kwaan |
| 4,564,054 | A | 1/1986 | Gustavsson |
| 4,573,993 | A | 3/1986 | Hoag et al. |
| 4,576,211 | A | 3/1986 | Valentini et al. |
| 4,581,014 | A | 4/1986 | Millerd et al. |
| 4,585,446 | A | 4/1986 | Kempf |
| 4,588,396 | A | 5/1986 | Stroebel et al. |
| 4,588,403 | A | 5/1986 | Weiss et al. |
| D284,603 | S | 7/1986 | Loignon |
| 4,604,093 | A | 8/1986 | Brown et al. |
| 4,607,671 | A | 8/1986 | Aalto et al. |
| 4,614,437 | A | 9/1986 | Buehler |
| 4,638,975 | A | 1/1987 | Iuchi et al. |
| 4,639,019 | A | 1/1987 | Mittleman |
| 4,667,927 | A | 5/1987 | Oscarsson |
| 4,675,020 | A | 6/1987 | McPhee |
| 4,676,530 | A | 6/1987 | Nordgren et al. |
| 4,683,975 | A | 8/1987 | Booth et al. |
| 4,697,622 | A | 10/1987 | Swift et al. |
| 4,721,133 | A | 1/1988 | Sundblom |
| 4,729,401 | A | 3/1988 | Raines |
| 4,735,608 | A | 4/1988 | Sardam |
| 4,743,229 | A | 5/1988 | Chu |
| 4,743,243 | A | 5/1988 | Vaillancourt |
| 4,752,292 | A | 6/1988 | Lopez et al. |
| 4,758,235 | A | 7/1988 | Tu |
| 4,759,756 | A | 7/1988 | Forman et al. |
| 4,778,447 | A | 10/1988 | Velde et al. |
| 4,787,898 | A | 11/1988 | Raines |
| 4,797,898 | A | 1/1989 | Martinez |
| D300,060 | S | 2/1989 | Molgaard-Nielsen |
| 4,804,366 | A | 2/1989 | Zdeb et al. |
| 4,826,492 | A | 5/1989 | Magasi |
| 4,832,690 | A | 5/1989 | Kuu |
| 4,834,152 | A | 5/1989 | Howson et al. |
| D303,013 | S | 8/1989 | Konopka |
| 4,857,062 | A | 8/1989 | Russell |
| 4,865,592 | A | 9/1989 | Rycroft |
| 4,871,463 | A | 10/1989 | Taylor et al. |
| 4,898,209 | A | 2/1990 | Zbed |
| 4,909,290 | A | 3/1990 | Coccia |
| 4,919,596 | A | 4/1990 | Slate et al. |
| 4,927,423 | A | 5/1990 | Malmborg |
| 4,931,040 | A | 6/1990 | Haber et al. |
| 4,932,944 | A | 6/1990 | Jagger et al. |
| 4,967,797 | A | 11/1990 | Manska |
| D314,050 | S | 1/1991 | Sone |
| D314,622 | S | 2/1991 | Andersson et al. |
| 4,997,430 | A | 3/1991 | Van der Heiden et al. |
| 5,006,114 | A | 4/1991 | Rogers et al. |
| 5,035,686 | A | 7/1991 | Crittenden et al. |
| 5,041,105 | A | 8/1991 | D'Alo et al. |
| 5,045,066 | A | 9/1991 | Scheuble et al. |
| 5,049,129 | A | 9/1991 | Zdeb et al. |
| 5,053,015 | A | 10/1991 | Gross |
| 5,061,248 | A | 10/1991 | Sacco |
| 5,088,996 | A | 2/1992 | Kopfer et al. |
| 5,096,575 | A | 3/1992 | Cosack |
| 5,104,387 | A | 4/1992 | Pokorney et al. |
| 5,113,904 | A | 5/1992 | Aslanian |
| 5,122,124 | A | 6/1992 | Novacek et al. |
| 5,125,908 | A | 6/1992 | Cohen |
| 5,125,915 | A | 6/1992 | Berry et al. |
| D328,788 | S | 8/1992 | Sagae et al. |
| 5,171,230 | A | 12/1992 | Eland et al. |
| 5,201,705 | A | 4/1993 | Berglund et al. |
| 5,201,717 | A | 4/1993 | Wyatt et al. |
| 5,203,771 | A | 4/1993 | Melker et al. |
| 5,203,775 | A | 4/1993 | Frank et al. |
| 5,211,638 | A | 5/1993 | Dudar et al. |
| 5,232,029 | A | 8/1993 | Knox et al. |
| 5,232,109 | A | 8/1993 | Tirrell et al. |
| 5,242,432 | A | 9/1993 | DeFrank |
| 5,247,972 | A | 9/1993 | Tetreault |
| D341,420 | S | 11/1993 | Conn |
| 5,269,768 | A | 12/1993 | Cheung |
| 5,270,219 | A | 12/1993 | DeCastro et al. |
| 5,279,576 | A | 1/1994 | Loo et al. |
| 5,288,290 | A | 2/1994 | Brody |
| 5,300,034 | A | 4/1994 | Behnke et al. |
| 5,301,685 | A | 4/1994 | Guirguis |
| 5,304,163 | A | 4/1994 | Bonnici et al. |
| 5,304,165 | A | 4/1994 | Haber et al. |
| 5,308,483 | A | 5/1994 | Sklar et al. |

(56) References Cited

U.S. PATENT DOCUMENTS 5,312,377 A 5/1994 Dalton
5,328,474 A 7/1994 Raines
D349,648 S 8/1994 Tirrell et al.
5,334,163 A 8/1994 Sinnett
5,334,179 A 8/1994 Poli et al.
5,342,346 A 8/1994 Honda et al.
5,344,417 A 9/1994 Wadsworth, Jr.
5,348,544 A 9/1994 Sweeney et al.
5,348,548 A 9/1994 Meyer et al.
5,350,372 A 9/1994 Ikeda et al.
5,364,386 A 11/1994 Fukuoka et al.
5,364,387 A 11/1994 Sweeney
5,374,264 A 12/1994 Wadsworth, Jr.
5,385,547 A 1/1995 Wong et al.
5,397,303 A 3/1995 Sancoff et al.
D357,733 S 4/1995 Matkovich
5,429,614 A 7/1995 Fowles et al.
5,433,330 A 7/1995 Yatsko et al.
5,445,630 A 8/1995 Richmond
5,445,631 A 8/1995 Uchida
D362,718 S 9/1995 Deily et al.
5,451,374 A 9/1995 Molina
5,454,805 A 10/1995 Brony
5,464,111 A 11/1995 Vacek et al.
5,464,123 A 11/1995 Scarrow
5,466,219 A 11/1995 Lynn et al.
5,466,220 A 11/1995 Brenneman
5,470,327 A 11/1995 Helgren et al.
5,471,994 A 12/1995 Guirguis
5,472,022 A 12/1995 Michel et al.
5,478,337 A 12/1995 Okamoto et al.
5,482,446 A 1/1996 Williamson et al.
5,492,147 A 2/1996 Challender et al.
5,496,274 A 3/1996 Graves et al.
D369,406 S 4/1996 Niedospial et al.
5,505,714 A 4/1996 Dassa et al.
5,509,433 A 4/1996 Paradis
5,515,871 A 5/1996 Bittner et al.
5,520,659 A 5/1996 Hedges
5,526,853 A 6/1996 McPhee et al.
5,527,306 A 6/1996 Raining
5,531,695 A 7/1996 Swisher
5,547,471 A 8/1996 Thompson et al.
5,549,577 A 8/1996 Siegel et al.
5,554,128 A 9/1996 Hedges
5,562,686 A 10/1996 Sauer et al.
5,562,696 A 10/1996 Nobles et al.
5,566,729 A 10/1996 Grabenkort et al.
5,569,191 A 10/1996 Meyer
5,573,281 A 11/1996 Keller
5,578,015 A 11/1996 Robb
5,583,052 A 12/1996 Portnoff et al.
5,584,819 A 12/1996 Kopfer
5,591,143 A 1/1997 Trombley, III et al.
5,603,706 A 2/1997 Wyatt et al.
5,607,439 A 3/1997 Yoon
5,611,576 A 3/1997 Guala
5,616,203 A 4/1997 Stevens
5,636,660 A 6/1997 Pfleiderer et al.
5,637,101 A 6/1997 Shillington
5,641,010 A 6/1997 Maier
5,645,538 A 7/1997 Richmond
5,647,845 A 7/1997 Haber et al.
5,651,776 A 7/1997 Appling et al.
5,653,686 A 8/1997 Coulter et al.
5,658,133 A 8/1997 Anderson et al.
5,672,160 A 9/1997 Osterlind et al.
5,674,195 A 10/1997 Truthan
5,676,346 A 10/1997 Leinsing
5,685,845 A 11/1997 Grimard
D388,172 S 12/1997 Cipes
5,699,821 A 12/1997 Paradis
5,702,019 A 12/1997 Grimard
5,718,346 A 2/1998 Weiler
5,728,087 A 3/1998 Niedospial, Jr.
D393,722 S 4/1998 Fangrow, Jr. et al.
5,738,144 A 4/1998 Rogers
5,743,312 A 4/1998 Pfeifer et al.
5,746,733 A 5/1998 Capaccio et al.
5,752,942 A 5/1998 Doyle et al.
5,755,696 A 5/1998 Caizza
5,766,211 A 6/1998 Wood et al.
5,772,630 A 6/1998 Ljungquist
5,772,652 A 6/1998 Zielinski
RE35,841 E 7/1998 Frank et al.
5,776,116 A 7/1998 Lopez et al.
5,782,872 A 7/1998 Muller
5,806,831 A 9/1998 Paradis
5,810,792 A 9/1998 Fangrow, Jr. et al.
5,814,020 A 9/1998 Gross
D399,559 S 10/1998 Molina
5,817,082 A 10/1998 Niedospial, Jr. et al.
5,820,621 A 10/1998 Yale et al.
5,827,262 A 10/1998 Neftel et al.
5,832,971 A 11/1998 Yale et al.
5,833,213 A 11/1998 Ryan
5,834,744 A 11/1998 Risman
5,839,715 A 11/1998 Leinsing
5,853,406 A 12/1998 Masuda et al.
D405,522 S 2/1999 Hoenig et al.
5,868,710 A 2/1999 Battiato et al.
5,871,110 A 2/1999 Grimard et al.
5,873,872 A 2/1999 Thibault et al.
5,879,337 A 3/1999 Kuracina et al.
5,879,345 A 3/1999 Aneas
5,887,633 A 3/1999 Yale et al.
5,890,610 A 4/1999 Jansen et al.
5,891,129 A 4/1999 Daubert et al.
5,893,397 A 4/1999 Peterson et al.
5,897,526 A 4/1999 Vaillancourt
5,899,468 A 5/1999 Apps et al.
5,902,280 A 5/1999 Powles et al.
5,902,298 A 5/1999 Niedospial, Jr. et al.
D410,740 S 6/1999 Molina
5,911,710 A 6/1999 Barry et al.
5,919,182 A 7/1999 Avallone
5,921,419 A 7/1999 Niedospial, Jr. et al.
5,924,584 A 7/1999 Hellstrom et al.
5,925,029 A 7/1999 Jansen et al.
5,935,112 A 8/1999 Stevens et al.
5,941,848 A 8/1999 Nishimoto et al.
5,941,850 A 8/1999 Shah et al.
5,944,700 A 8/1999 Nguyen et al.
5,954,104 A 9/1999 Daubert et al.
5,968,022 A 10/1999 Saito
5,971,181 A 10/1999 Niedospial, Jr. et al.
5,971,965 A 10/1999 Mayer
5,989,237 A 11/1999 Fowles et al.
6,003,566 A 12/1999 Thibault et al.
6,004,278 A 12/1999 Botich et al.
6,019,750 A 2/2000 Fowles et al.
6,022,339 A 2/2000 Fowles et al.
6,036,171 A 3/2000 Weinheimer et al.
6,039,093 A 3/2000 Mrotzek et al.
6,039,302 A 3/2000 Cote, Sr. et al.
D422,357 S 4/2000 Niedospial, Jr. et al.
6,063,068 A 5/2000 Fowles et al.
D427,308 S 6/2000 Zinger
D427,309 S 6/2000 Molina
6,070,623 A 6/2000 Aneas
6,071,270 A 6/2000 Fowles et al.
6,080,132 A 6/2000 Cole et al.
D428,141 S 7/2000 Brotspies et al.
6,086,762 A 7/2000 Guala
6,089,541 A 7/2000 Weinheimer et al.
6,090,091 A 7/2000 Fowles et al.
6,090,093 A 7/2000 Thibault et al.
6,092,692 A 7/2000 Riskin
D430,291 S 8/2000 Jansen et al.
6,099,511 A 8/2000 Devos et al.
6,113,068 A 9/2000 Ryan
6,113,583 A 9/2000 Fowles et al.
6,117,114 A 9/2000 Paradis
D431,864 S 10/2000 Jansen

(56) References Cited

U.S. PATENT DOCUMENTS 6,139,534 A 10/2000 Niedospial, Jr. et al.
6,142,446 A 11/2000 Leinsing
6,146,362 A 11/2000 Turnbull et al.
6,149,623 A 11/2000 Reynolds
6,156,025 A 12/2000 Niedospial, Jr. et al.
6,159,192 A 12/2000 Fowles et al.
6,168,037 B1 1/2001 Grimard
6,171,287 B1 1/2001 Lynn et al.
6,171,293 B1 1/2001 Rowley et al.
6,173,852 B1 1/2001 Browne
6,173,868 B1 1/2001 DeJonge
6,174,304 B1 1/2001 Weston
6,179,822 B1 1/2001 Niedospial, Jr.
6,179,823 B1 1/2001 Niedospial, Jr.
6,186,997 B1 2/2001 Gabbard et al.
6,206,861 B1 3/2001 Mayer
6,221,041 B1 4/2001 Russo
6,221,054 B1 4/2001 Martin et al.
6,221,065 B1 4/2001 Davis
6,238,372 B1 5/2001 Zinger et al.
6,245,044 B1 6/2001 Daw et al.
D445,501 S 7/2001 Niedospial, Jr.
D445,895 S 7/2001 Svendsen
6,253,804 B1 7/2001 Safabash
6,258,078 B1 7/2001 Thilly
6,280,430 B1 8/2001 Neftel et al.
6,290,688 B1 9/2001 Lopez et al.
6,296,621 B1 10/2001 Masuda et al.
6,299,131 B1 10/2001 Ryan
6,343,629 B1 2/2002 Wessman et al.
6,348,044 B1 2/2002 Coletti et al.
6,358,236 B1 3/2002 DeFoggi et al.
6,364,866 B1 4/2002 Furr et al.
6,378,576 B2 4/2002 Thibault et al.
6,378,714 B1 4/2002 Jansen et al.
6,379,340 B1 4/2002 Zinger et al.
D457,954 S 5/2002 Wallace et al.
6,382,442 B1 5/2002 Thibault et al.
6,386,397 B2 5/2002 Brotspies et al.
6,408,897 B1 6/2002 Laurent et al.
6,409,708 B1 6/2002 Wessman
6,440,107 B1 8/2002 Trombley, III et al.
6,453,949 B1 9/2002 Chau
6,453,956 B2 9/2002 Safabash
6,474,375 B2 11/2002 Spero et al.
6,478,788 B1 11/2002 Aneas
D468,015 S 12/2002 Horppu
6,499,617 B1 12/2002 Niedospial, Jr. et al.
6,503,240 B1 1/2003 Niedospial, Jr. et al.
6,503,244 B2 1/2003 Hayman
6,520,932 B2 2/2003 Taylor
6,524,278 B1 2/2003 Campbell et al.
6,524,295 B2 2/2003 Daubert et al.
D472,316 S 3/2003 Douglas et al.
6,530,903 B2 3/2003 Wang et al.
6,537,263 B1 3/2003 Aneas
D472,630 S 4/2003 Douglas et al.
6,544,246 B1 4/2003 Niedospial, Jr.
6,551,299 B2 4/2003 Miyoshi et al.
6,558,365 B2 5/2003 Zinger et al.
6,571,837 B2 6/2003 Jansen et al.
6,572,591 B2 6/2003 Mayer
6,575,955 B2 6/2003 Azzolini
6,581,593 B1 6/2003 Rubin et al.
6,582,415 B1 6/2003 Fowles et al.
D476,731 S 7/2003 Cise et al.
6,591,876 B2 7/2003 Safabash
6,599,273 B1 7/2003 Lopez
6,601,721 B2 8/2003 Jansen et al.
6,626,309 B1 9/2003 Jansen et al.
6,632,201 B1 10/2003 Mathias et al.
6,638,244 B1 10/2003 Reynolds
D482,121 S 11/2003 Harding et al.
D482,447 S 11/2003 Harding et al.
6,651,956 B2 11/2003 Miller
6,652,509 B1 11/2003 Helgren et al.
D483,487 S 12/2003 Harding et al.
D483,869 S 12/2003 Tran et al.
6,656,433 B2 12/2003 Sasso
6,666,852 B2 12/2003 Niedospial, Jr.
6,681,810 B2 1/2004 Weston
6,681,946 B1 1/2004 Jansen et al.
6,682,509 B2 1/2004 Lopez
6,692,478 B1 2/2004 Paradis
6,692,829 B2 2/2004 Stubler et al.
6,695,829 B2 2/2004 Hellstrom et al.
6,699,229 B2 3/2004 Zinger et al.
6,706,022 B1 3/2004 Leinsing et al.
6,706,031 B2 3/2004 Manera
6,715,520 B2 4/2004 Andreasson et al.
6,729,370 B2 5/2004 Norton et al.
6,736,798 B2 5/2004 Ohkubo et al.
6,745,998 B2 6/2004 Doyle
6,746,438 B1 6/2004 Amissolle
6,752,180 B2 6/2004 Delay
D495,416 S 8/2004 Dimeo et al.
D496,457 S 9/2004 Prais et al.
6,802,490 B2 10/2004 Leinsing et al.
6,832,994 B2 12/2004 Niedospial, Jr. et al.
6,852,103 B2 2/2005 Fowles et al.
6,875,203 B1 4/2005 Fowles et al.
6,875,205 B2 4/2005 Leinsing
6,878,131 B2 4/2005 Novacek et al.
6,884,253 B1 4/2005 McFarlane
6,890,328 B2 5/2005 Fowles et al.
D506,256 S 6/2005 Miyoshi et al.
6,901,975 B2 6/2005 Aramata et al.
6,945,417 B2 9/2005 Jansen et al.
6,948,522 B2 9/2005 Newbrough et al.
6,949,086 B2 9/2005 Ferguson et al.
6,951,613 B2 10/2005 Reif et al.
6,957,745 B2 10/2005 Thibault et al.
6,960,164 B2 11/2005 O'Heeron
6,972,002 B2 12/2005 Thorne
6,979,318 B1 12/2005 McDonald et al.
RE38,996 E 2/2006 Crawford et al.
6,994,315 B2 2/2006 Ryan et al.
6,997,916 B2 2/2006 Simas, Jr. et al.
6,997,917 B2 2/2006 Niedospial, Jr. et al.
7,024,968 B2 4/2006 Raudabough et al.
7,070,589 B2 7/2006 Lolachi et al.
7,074,216 B2 7/2006 Fowles et al.
7,083,600 B2 8/2006 Meloul
7,086,431 B2 8/2006 D'Antonio et al.
7,097,637 B2 8/2006 Triplett et al.
7,100,890 B2 9/2006 Cote, Sr. et al.
7,140,401 B2 11/2006 Wilcox et al.
7,150,735 B2 12/2006 Hickle
7,192,423 B2 3/2007 Wong
7,195,623 B2 3/2007 Burroughs et al.
7,241,285 B1 7/2007 Dikeman
7,294,122 B2 * 11/2007 Kubo ..... A61J 1/2089
604/410
7,306,199 B2 12/2007 Leinsing et al.
D561,348 S 2/2008 Zinger et al.
7,326,188 B1 2/2008 Russell et al.
7,326,194 B2 2/2008 Zinger et al.
7,350,764 B2 4/2008 Raybuck
7,354,422 B2 4/2008 Riesenberger et al.
7,354,427 B2 4/2008 Fangrow
7,425,209 B2 9/2008 Fowles et al.
7,435,246 B2 10/2008 Zihlmann
D580,558 S 11/2008 Shigesada et al.
7,452,348 B2 11/2008 Hasegawa
7,470,257 B2 12/2008 Norton et al.
7,470,265 B2 12/2008 Brugger et al.
7,472,932 B2 1/2009 Weber et al.
7,488,297 B2 2/2009 Flaherty
7,491,197 B2 * 2/2009 Jansen ..... A61J 1/2089
604/246
7,497,848 B2 3/2009 Leinsing et al.
7,523,967 B2 4/2009 Steppe
7,530,546 B2 5/2009 Ryan et al.
D595,420 S 6/2009 Suzuki et al.

(56) References Cited

U.S. PATENT DOCUMENTS

| | | | |
|---|---|---|---|
| D595,421 | S | 6/2009 | Suzuki et al. |
| 7,540,863 | B2 | 6/2009 | Haindl |
| 7,540,865 | B2 | 6/2009 | Griffin et al. |
| 7,544,191 | B2 | 6/2009 | Peluso et al. |
| D595,862 | S | 7/2009 | Suzuki et al. |
| D595,863 | S | 7/2009 | Suzuki et al. |
| 7,611,487 | B2 | 11/2009 | Woehr et al. |
| 7,611,502 | B2 | 11/2009 | Daly |
| 7,615,041 | B2 | 11/2009 | Sullivan et al. |
| 7,628,779 | B2 | 12/2009 | Aneas |
| 7,632,261 | B2 | 12/2009 | Zinger et al. |
| D608,900 | S | 1/2010 | Giraud et al. |
| 7,654,995 | B2 | 2/2010 | Warren et al. |
| 7,670,326 | B2 | 3/2010 | Shemesh |
| 7,695,445 | B2 | 4/2010 | Yuki |
| 7,704,229 | B2 | 4/2010 | Moberg et al. |
| D616,090 | S | 5/2010 | Kawamura |
| 7,713,247 | B2 | 5/2010 | Lopez |
| 7,717,886 | B2 | 5/2010 | Lopez |
| 7,722,090 | B2 | 5/2010 | Burton et al. |
| D616,984 | S | 6/2010 | Gilboa |
| 7,731,678 | B2 | 6/2010 | Tennican et al. |
| 7,743,799 | B2 | 6/2010 | Mosier et al. |
| 7,744,581 | B2 | 6/2010 | Wallen et al. |
| 7,757,901 | B2 | 7/2010 | Welp |
| 7,758,082 | B2 | 7/2010 | Weigel et al. |
| 7,758,560 | B2 | 7/2010 | Connell et al. |
| 7,762,524 | B2 | 7/2010 | Cawthon et al. |
| 7,766,304 | B2 | 8/2010 | Phillips |
| 7,771,383 | B2 | 8/2010 | Truitt |
| D624,641 | S | 9/2010 | Boclet |
| 7,799,009 | B2 | 9/2010 | Niedospial, Jr. et al. |
| 7,803,140 | B2 | 9/2010 | Fangrow, Jr. |
| D627,216 | S | 11/2010 | Fulginiti |
| D630,732 | S | 1/2011 | Lev et al. |
| 7,862,537 | B2 | 1/2011 | Zinger et al. |
| 7,867,215 | B2 | 1/2011 | Akerlund et al. |
| 7,879,018 | B2 | 2/2011 | Zinger et al. |
| 7,883,499 | B2 | 2/2011 | Fangrow |
| 7,895,216 | B2 | 2/2011 | Longshaw et al. |
| D634,007 | S | 3/2011 | Zinger et al. |
| 7,900,659 | B2 | 3/2011 | Whitley et al. |
| D637,713 | S | 5/2011 | Nord et al. |
| 7,963,954 | B2 | 6/2011 | Kavazov |
| D641,080 | S | 7/2011 | Zinger et al. |
| 7,985,216 | B2 | 7/2011 | Daily et al. |
| D644,104 | S | 8/2011 | Maeda et al. |
| 7,993,328 | B2 | 8/2011 | Whitley |
| 8,007,461 | B2 | 8/2011 | Huo et al. |
| 8,012,132 | B2 | 9/2011 | Lum et al. |
| 8,016,809 | B2 | 9/2011 | Zinger et al. |
| 8,021,325 | B2 | 9/2011 | Zinger et al. |
| 8,025,653 | B2 | 9/2011 | Capitaine et al. |
| 8,025,683 | B2 | 9/2011 | Morrison |
| 8,029,472 | B2 | 10/2011 | Leinsing et al. |
| 8,038,123 | B2 | 10/2011 | Ruschke et al. |
| 8,066,688 | B2 | 11/2011 | Zinger et al. |
| 8,070,739 | B2 | 12/2011 | Zinger et al. |
| 8,075,550 | B2 | 12/2011 | Nord et al. |
| 8,096,525 | B2 | 1/2012 | Ryan |
| 8,105,314 | B2 | 1/2012 | Fangrow, Jr. |
| D654,166 | S | 2/2012 | Lair |
| D655,017 | S | 2/2012 | Mosler et al. |
| 8,122,923 | B2 | 2/2012 | Kraus et al. |
| 8,123,736 | B2 | 2/2012 | Kraushaar et al. |
| D655,071 | S | 3/2012 | Davila |
| D657,461 | S | 4/2012 | Schembre et al. |
| 8,152,779 | B2 | 4/2012 | Cabiri |
| 8,157,784 | B2 | 4/2012 | Rogers |
| 8,167,863 | B2 | 5/2012 | Yow |
| 8,172,824 | B2 | 5/2012 | Pfeifer et al. |
| 8,177,768 | B2 | 5/2012 | Leinsing |
| 8,182,452 | B2 | 5/2012 | Mansour et al. |
| 8,187,248 | B2 | 5/2012 | Zihlmann |
| 8,196,614 | B2 | 6/2012 | Kriheli |
| 8,197,459 | B2 | 6/2012 | Jansen et al. |
| 8,211,069 | B2 | 7/2012 | Fangrow, Jr. |
| 8,225,959 | B2 | 7/2012 | Lambrecht |
| 8,241,268 | B2 | 8/2012 | Whitley |
| 8,262,628 | B2 | 9/2012 | Fangrow, Jr. |
| 8,262,641 | B2 | 9/2012 | Vedrine et al. |
| 8,267,127 | B2 | 9/2012 | Kriheli |
| D669,980 | S | 10/2012 | Lev et al. |
| 8,287,513 | B2 | 10/2012 | Ellstrom et al. |
| 8,328,784 | B2 | 12/2012 | Jensen et al. |
| D673,673 | S | 1/2013 | Wang |
| D674,084 | S | 1/2013 | Linnenschmidt |
| D674,088 | S | 1/2013 | Lev et al. |
| 8,348,898 | B2 | 1/2013 | Cabiri |
| D681,230 | S | 4/2013 | Mosler et al. |
| 8,454,573 | B2 | 6/2013 | Wyatt et al. |
| 8,469,939 | B2 | 6/2013 | Fangrow, Jr. |
| 8,475,404 | B2 | 7/2013 | Foshee et al. |
| 8,480,645 | B1 | 7/2013 | Choudhury et al. |
| 8,480,646 | B2 | 7/2013 | Nord et al. |
| 8,506,548 | B2 | 8/2013 | Okiyama |
| 8,511,352 | B2 | 8/2013 | Kraus et al. |
| 8,512,309 | B2 | 8/2013 | Shemesh et al. |
| D690,009 | S | 9/2013 | Schembre et al. |
| D690,418 | S | 9/2013 | Rosenquist |
| 8,523,837 | B2 | 9/2013 | Wiggins et al. |
| 8,545,476 | B2 | 10/2013 | Ariagno et al. |
| 8,551,067 | B2 | 10/2013 | Zinger et al. |
| 8,556,879 | B2 | 10/2013 | Okiyama |
| 8,562,582 | B2 | 10/2013 | Tuckwell et al. |
| 8,608,723 | B2 | 12/2013 | Lev et al. |
| 8,628,508 | B2 | 1/2014 | Weitzel et al. |
| 8,636,689 | B2 | 1/2014 | Halili, Jr. et al. |
| 8,684,992 | B2 | 4/2014 | Sullivan et al. |
| 8,684,994 | B2 | 4/2014 | Lev et al. |
| 8,752,598 | B2 | 6/2014 | Denenburg et al. |
| D714,935 | S | 10/2014 | Nishioka et al. |
| D717,406 | S | 11/2014 | Stanley et al. |
| D717,948 | S | 11/2014 | Strong et al. |
| D719,650 | S | 12/2014 | Arinobe et al. |
| D720,067 | S | 12/2014 | Rosenquist |
| D720,451 | S | 12/2014 | Denenburg et al. |
| D720,452 | S | 12/2014 | Jordan |
| 8,900,212 | B2 | 12/2014 | Kubo |
| 8,905,994 | B1 | 12/2014 | Lev |
| 8,915,882 | B2 | 12/2014 | Cabiri |
| D720,850 | S | 1/2015 | Hsia et al. |
| D732,660 | S | 6/2015 | Ohashi |
| D732,664 | S | 6/2015 | Woehr et al. |
| D733,291 | S | 6/2015 | Wang |
| D733,292 | S | 6/2015 | Rogers |
| D733,293 | S | 6/2015 | Rogers |
| 9,072,827 | B2 | 7/2015 | Cabiri |
| D738,494 | S | 9/2015 | Kashmirian |
| D741,457 | S | 10/2015 | Guest |
| 9,149,575 | B2 | 10/2015 | Cabiri |
| D750,235 | S | 2/2016 | Maurice |
| 9,254,242 | B2 | 2/2016 | Mueller et al. |
| D757,933 | S | 5/2016 | Lev et al. |
| 9,393,365 | B2 | 7/2016 | Cabiri |
| 9,486,391 | B2 | 11/2016 | Shemesh |
| 9,492,610 | B2 | 11/2016 | Cabiri |
| 9,511,190 | B2 | 12/2016 | Cabiri |
| 9,522,234 | B2 | 12/2016 | Cabiri |
| D794,183 | S | 8/2017 | Lev et al. |
| 9,763,855 | B2 | 9/2017 | Fangrow |
| 10,206,854 | B2 | 2/2019 | Wu et al. |
| 2001/0000347 | A1 | 4/2001 | Hellstrom et al. |
| 2001/0025671 | A1 | 10/2001 | Safabash |
| 2001/0029360 | A1 | 10/2001 | Miyoshi et al. |
| 2001/0051793 | A1 | 12/2001 | Weston |
| 2002/0017328 | A1 | 2/2002 | Loo |
| 2002/0055711 | A1 | 5/2002 | Lavi et al. |
| 2002/0065488 | A1 | 5/2002 | Suzuki et al. |
| 2002/0066715 | A1 | 6/2002 | Niedospial |
| 2002/0087118 | A1 | 7/2002 | Reynolds et al. |
| 2002/0087141 | A1* | 7/2002 | Zinger ..... A61J 1/2089 604/414 |
| 2002/0087144 | A1 | 7/2002 | Zinger |

(56) References Cited

U.S. PATENT DOCUMENTS

2002/0104584 A1 8/2002 Spero et al.
2002/0115980 A1 8/2002 Niedospial et al.
2002/0121496 A1 9/2002 Thiebault et al.
2002/0123736 A1 9/2002 Fowles et al.
2002/0127150 A1 9/2002 Sasso
2002/0128628 A1 9/2002 Fathallah
2002/0138045 A1 9/2002 Moen
2002/0173752 A1 11/2002 Polzin
2002/0193777 A1 12/2002 Aneas
2003/0028156 A1 2/2003 Juliar
2003/0036725 A1 2/2003 Lavi et al.
2003/0068354 A1 4/2003 Reif et al.
2003/0069550 A1 4/2003 Sharp
2003/0073971 A1 4/2003 Saker
2003/0100866 A1 5/2003 Reynolds
2003/0109846 A1 6/2003 Zinger et al.
2003/0120209 A1 6/2003 Jensen et al.
2003/0135159 A1 7/2003 Daily et al.
2003/0153895 A1 8/2003 Leinsing
2003/0187420 A1 10/2003 Akerlund et al.
2003/0191445 A1 10/2003 Wallen et al.
2003/0195479 A1 10/2003 Kuracina et al.
2003/0199827 A1 10/2003 Thorne
2003/0199846 A1 10/2003 Fowles et al.
2003/0199847 A1 10/2003 Akerlund et al.
2003/0205843 A1 11/2003 Adams
2003/0236543 A1 12/2003 Brenneman et al.
2004/0010207 A1 1/2004 Flaherty et al.
2004/0024354 A1 2/2004 Reynolds
2004/0039365 A1 2/2004 Aramata et al.
2004/0044327 A1 3/2004 Hasegawa
2004/0073189 A1 4/2004 Wyatt et al.
2004/0143218 A1 7/2004 Das
2004/0143226 A1 7/2004 Marsden
2004/0153047 A1 8/2004 Blank et al.
2004/0158172 A1 8/2004 Hancock
2004/0162540 A1 8/2004 Walenciak et al.
2004/0167472 A1 8/2004 Howell et al.
2004/0181192 A1 9/2004 Cuppy
2004/0186424 A1 9/2004 Hjertman
2004/0199139 A1 10/2004 Fowles et al.
2004/0204699 A1 10/2004 Hanly et al.
2004/0217315 A1 11/2004 Doyle
2004/0225274 A1 11/2004 Jansen et al.
2004/0236305 A1 11/2004 Jansen et al.
2004/0249341 A1 12/2004 Newbrough et al.
2004/0255952 A1 12/2004 Carlsen et al.
2005/0015070 A1 1/2005 Delnevo et al.
2005/0016626 A1 1/2005 Wilcox et al.
2005/0049553 A1 3/2005 Triplett et al.
2005/0055008 A1 3/2005 Paradis et al.
2005/0082828 A1 4/2005 Wicks et al.
2005/0124964 A1 6/2005 Niedospial et al.
2005/0137523 A1 6/2005 Wyatt et al.
2005/0137566 A1 6/2005 Fowles et al.
2005/0148994 A1 7/2005 Leinsing
2005/0159706 A1 7/2005 Wilkinson et al.
2005/0159724 A1 7/2005 Enerson
2005/0182383 A1 8/2005 Wallen
2005/0209554 A1 9/2005 Landau
2005/0261637 A1 11/2005 Miller
2005/0277896 A1 12/2005 Messerli et al.
2006/0030832 A1 2/2006 Niedospial et al.
2006/0079834 A1 4/2006 Tennican et al.
2006/0089594 A1 4/2006 Landau
2006/0089603 A1 4/2006 Truitt et al.
2006/0095015 A1 5/2006 Hobbs et al.
2006/0106360 A1 5/2006 Wong
2006/0135948 A1 6/2006 Varma
2006/0155257 A1 7/2006 Reynolds
2006/0161192 A1 7/2006 Young
2006/0173410 A1 8/2006 Moberg et al.
2006/0178646 A1 8/2006 Harris et al.
2006/0195029 A1 8/2006 Shults et al.
2006/0212004 A1 9/2006 Atil
2006/0253084 A1 11/2006 Nordgren
2006/0259004 A1 11/2006 Connell et al.
2007/0016381 A1 1/2007 Kamath et al.
2007/0024995 A1 2/2007 Hayashi
2007/0060904 A1 3/2007 Vedrine et al.
2007/0078428 A1 4/2007 Reynolds et al.
2007/0079894 A1 4/2007 Kraus et al.
2007/0083164 A1 4/2007 Barrelle et al.
2007/0088252 A1 4/2007 Pestotnik et al.
2007/0088293 A1 4/2007 Fangrow
2007/0088313 A1 4/2007 Zinger et al.
2007/0106218 A1 5/2007 Yodfat et al.
2007/0106244 A1 5/2007 Mosler et al.
2007/0112324 A1 5/2007 Hamedi-Sangsari
2007/0156112 A1 7/2007 Walsh
2007/0167904 A1 7/2007 Zinger et al.
2007/0167912 A1 7/2007 Causey et al.
2007/0191760 A1 8/2007 Iguchi et al.
2007/0191764 A1 8/2007 Zihlmann
2007/0191767 A1 8/2007 Hennessy et al.
2007/0203451 A1 8/2007 Murakami et al.
2007/0219483 A1 9/2007 Kitani et al.
2007/0244447 A1 10/2007 Capitaine et al.
2007/0244461 A1 10/2007 Fangrow
2007/0244462 A1 10/2007 Fangrow
2007/0244463 A1 10/2007 Warren et al.
2007/0249995 A1 10/2007 Van Manen
2007/0255202 A1 11/2007 Kitani et al.
2007/0265574 A1 11/2007 Tennican et al.
2007/0265581 A1 11/2007 Funamura et al.
2007/0270778 A9 11/2007 Zinger et al.
2007/0287953 A1 12/2007 Ziv et al.
2007/0299404 A1 12/2007 Katoh et al.
2008/0009789 A1 1/2008 Zinger et al.
2008/0009822 A1 1/2008 Enerson
2008/0015496 A1 1/2008 Harnedi-Sangsari
2008/0135051 A1 6/2008 Lee
2008/0172024 A1 7/2008 Yow
2008/0188799 A1 8/2008 Mueller-Beckhaus et al.
2008/0195049 A1 8/2008 Thalmann et al.
2008/0208138 A1 8/2008 Lim
2008/0215015 A1 9/2008 Cindrich et al.
2008/0249473 A1 10/2008 Rutti et al.
2008/0249479 A1 10/2008 Zinger et al.
2008/0249498 A1 10/2008 Fangrow
2008/0262465 A1 10/2008 Zinger et al.
2008/0269687 A1 10/2008 Chong
2008/0275407 A1 11/2008 Scheurer
2008/0287905 A1 11/2008 Hiejima et al.
2008/0294100 A1 11/2008 de Costa et al.
2008/0306439 A1 12/2008 Nelson et al.
2008/0312634 A1 12/2008 Helmerson et al.
2009/0012492 A1 1/2009 Zihlmann
2009/0043253 A1 2/2009 Podaima
2009/0054834 A1 2/2009 Zinger et al.
2009/0054852 A1 2/2009 Takano et al.
2009/0062767 A1 3/2009 Van Antwerp et al.
2009/0076360 A1 3/2009 Brister et al.
2009/0082750 A1 3/2009 Denenburg et al.
2009/0139724 A1 6/2009 Gray et al.
2009/0143758 A1 6/2009 Okiyama
2009/0177177 A1 7/2009 Zinger et al.
2009/0177178 A1 7/2009 Pedersen
2009/0187140 A1 7/2009 Racz
2009/0216103 A1 8/2009 Brister et al.
2009/0216212 A1 8/2009 Fangrow, Jr.
2009/0267011 A1 10/2009 Hatton et al.
2009/0299325 A1 12/2009 Vedrine et al.
2009/0318946 A1 12/2009 Tamesada
2009/0326506 A1 12/2009 Hasegawa et al.
2010/0010443 A1 1/2010 Morgan et al.
2010/0016811 A1 1/2010 Smith
2010/0022985 A1 1/2010 Sullivan et al.
2010/0030181 A1 2/2010 Helle et al.
2010/0036319 A1 2/2010 Drake et al.
2010/0076397 A1 3/2010 Reed et al.
2010/0087786 A1 4/2010 Zinger et al.
2010/0137827 A1 6/2010 Warren et al.
2010/0137831 A1 6/2010 Tsals

(56) References Cited

U.S. PATENT DOCUMENTS

2010/0152658 A1 6/2010 Hanson et al.
2010/0160889 A1 6/2010 Smith et al.
2010/0162548 A1 7/2010 Leidig
2010/0168664 A1 7/2010 Zinger
2010/0168712 A1 7/2010 Tuckwell et al.
2010/0179506 A1 7/2010 Shemesh et al.
2010/0198148 A1 8/2010 Zinger
2010/0204670 A1 8/2010 Kraushaar et al.
2010/0228220 A1 9/2010 Zinger et al.
2010/0241088 A1 9/2010 Ranalletta et al.
2010/0274184 A1 10/2010 Chun
2010/0274202 A1 10/2010 Hyde et al.
2010/0286661 A1 11/2010 Raday et al.
2010/0312220 A1 12/2010 Kalitzki
2011/0004143 A1 1/2011 Beiriger et al.
2011/0004184 A1 1/2011 Proksch et al.
2011/0044850 A1 2/2011 Solomon et al.
2011/0054440 A1 3/2011 Lewis
2011/0087164 A1* 4/2011 Mosler ..... A61J 1/2089 604/87
2011/0125056 A1 5/2011 Merchant
2011/0144584 A1 6/2011 Wozencroft
2011/0160655 A1 6/2011 Hanson et al.
2011/0160701 A1 6/2011 Wyatt et al.
2011/0172636 A1 7/2011 Aasmul
2011/0175347 A1 7/2011 Okiyama
2011/0218511 A1 9/2011 Yokoyama
2011/0224640 A1 9/2011 Kuhn et al.
2011/0230856 A1 9/2011 Kyle et al.
2011/0264037 A1 10/2011 Foshee et al.
2011/0264069 A1 10/2011 Bochenko
2011/0276007 A1 11/2011 Denenburg
2011/0319827 A1 12/2011 Leinsing et al.
2012/0022344 A1 1/2012 Kube
2012/0022469 A1 1/2012 Alpert
2012/0053555 A1* 3/2012 Ariagno ..... A61J 1/2089 604/413
2012/0059332 A1 3/2012 Woehr et al.
2012/0059346 A1 3/2012 Sheppard et al.
2012/0067429 A1 3/2012 Mosler et al.
2012/0071819 A1 3/2012 Bruggemann et al.
2012/0078214 A1 3/2012 Finke et al.
2012/0123382 A1 5/2012 Kubo
2012/0184938 A1 7/2012 Lev et al.
2012/0215182 A1 8/2012 Mansour et al.
2012/0220977 A1 8/2012 Yow
2012/0220978 A1 8/2012 Lev et al.
2012/0265163 A1 10/2012 Cheng et al.
2012/0271229 A1 10/2012 Lev et al.
2012/0296307 A1 11/2012 Holt et al.
2012/0310203 A1 12/2012 Khaled et al.
2012/0323172 A1 12/2012 Lev et al.
2012/0323187 A1 12/2012 Iwase et al.
2012/0323210 A1 12/2012 Lev et al.
2013/0046269 A1 2/2013 Lev et al.
2013/0053814 A1 2/2013 Mueller-Beckhaus et al.
2013/0096493 A1 4/2013 Kubo et al.
2013/0110049 A1 5/2013 Cronenberg et al.
2013/0144248 A1 6/2013 Putter et al.
2013/0199669 A1 8/2013 Moy et al.
2013/0226100 A1 8/2013 Lev
2013/0231630 A1 9/2013 Kraus et al.
2013/0237904 A1 9/2013 Deneburg et al.
2013/0253448 A1 9/2013 Baron et al.
2013/0289530 A1 10/2013 Wyatt et al.
2014/0020793 A1* 1/2014 Denenburg ..... A61J 1/2089 141/329
2014/0096862 A1 4/2014 Aneas
2014/0150911 A1 6/2014 Hanner et al.
2014/0194854 A1 7/2014 Tsals
2014/0221940 A1 8/2014 Clauson et al.
2014/0277052 A1 9/2014 Haselby et al.
2014/0352845 A1 12/2014 Lev et al.
2015/0082746 A1 3/2015 Ivosevic et al.
2015/0088078 A1 3/2015 Lev et al.
2015/0112297 A1 4/2015 Lev et al.
2015/0290390 A1 10/2015 Ring et al.
2015/0297839 A1 10/2015 Sanders et al.
2015/0305770 A1 10/2015 Fill et al.
2016/0088995 A1 3/2016 Ueda et al.
2016/0199569 A1 7/2016 Yevmenenko et al.
2016/0228644 A1 8/2016 Cabiri
2016/0287475 A1 10/2016 Yevmenenko et al.
2016/0367439 A1* 12/2016 Davis ..... A61J 1/2096
2019/0133885 A1 5/2019 Wu et al.

FOREIGN PATENT DOCUMENTS

CN 1747683 A 3/2006
CN 1863566 A 11/2006
CN 1950049 A 4/2007
CN 101001661 A 7/2007
CN 101687083 A 3/2010
DE 1064693 B 9/1959
DE 1913926 A1 9/1970
DE 4122476 A1 1/1993
DE 4408498 A1 5/1995
DE 19504413 A1 8/1996
DE 202004012714 U1 11/2004
DE 102007046951 B3 2/2009
DE 202009011019 U1 12/2010
EM 000627237-0001 1/2007
EM 001680703-0002 3/2010
EP 0192661 A1 9/1986
EP 0195018 A1 9/1986
EP 0258913 A2 3/1988
EP 0416454 A2 3/1991
EP 0426403 A1 5/1991
EP 0282545 B1 2/1992
EP 0518397 A1 12/1992
EP 0521460 A1 1/1993
EP 582038 A2 2/1994
EP 0598918 A1 6/1994
EP 0637443 A1 2/1995
EP 0737467 A1 10/1996
EP 761562 A1 3/1997
EP 765652 A1 4/1997
EP 765853 A1 4/1997
EP 0806597 A1 11/1997
EP 0814866 A1 1/1998
EP 829248 A2 3/1998
EP 0856331 A2 8/1998
EP 882441 A2 12/1998
EP 0887085 A2 12/1998
EP 0887885 A2 12/1998
EP 897708 A2 2/1999
EP 0898951 A2 3/1999
EP 960616 A2 12/1999
EP 1008337 A1 6/2000
EP 1029526 A1 8/2000
EP 1034809 A1 9/2000
EP 1051988 A2 11/2000
EP 1323403 A1 7/2003
EP 1329210 A1 7/2003
EP 1396250 A1 3/2004
EP 1454609 A1 9/2004
EP 1454650 A1 9/2004
EP 1498097 A2 1/2005
EP 1872824 A1 1/2008
EP 1911432 A1 4/2008
EP 1919432 A1 5/2008
EP 1930038 A2 6/2008
EP 2090278 A1 8/2009
EP 2351548 A1 8/2011
EP 2351549 A1 8/2011
EP 2462913 A1 6/2012
EP 2512399 A1 10/2012
FR 2029242 A5 10/1970
FR 2856660 A1 12/2004
FR 2869795 A1 11/2005
FR 2931363 A1 11/2009
GB 1444210 A 7/1976
IL 186290 1/2008
JP 03-062426 B 9/1991

(56) References Cited

FOREIGN PATENT DOCUMENTS

| | | | |
|---|---|---|---|
| JP | 06-050656 | U | 7/1994 |
| JP | H08-000710 | A | 1/1996 |
| JP | 09-104460 | A | 4/1997 |
| JP | 09-104461 | A | 4/1997 |
| JP | 10-118158 | | 5/1998 |
| JP | H10-504736 | A | 5/1998 |
| JP | H11503627 | A | 3/1999 |
| JP | 11-319031 | A | 11/1999 |
| JP | 2000-508934 | A | 7/2000 |
| JP | 2000-237278 | A | 9/2000 |
| JP | 2000262497 | A | 9/2000 |
| JP | 2001-505083 | A | 4/2001 |
| JP | 2002-035140 | A | 2/2002 |
| JP | 2002-516160 | A | 6/2002 |
| JP | 2002-355318 | A | 12/2002 |
| JP | 2003-033441 | A | 2/2003 |
| JP | 2003-102807 | A | 4/2003 |
| JP | 2004-501721 | A | 1/2004 |
| JP | 2004-097253 | A | 4/2004 |
| JP | 2004-522541 | A | 7/2004 |
| JP | 2005-270629 | A | 10/2005 |
| JP | 200661421 | A | 3/2006 |
| JP | 2008-220961 | A | 9/2008 |
| JP | 4329954 | B2 | 9/2009 |
| JP | 2010063622 | A | 3/2010 |
| JP | 2010-179128 | A | 8/2010 |
| JP | 2012-205769 | A | 10/2012 |
| JP | 2014000220 | A | 1/2014 |
| WO | 8601712 | A1 | 3/1986 |
| WO | 8605683 | A1 | 10/1986 |
| WO | 9003536 | A1 | 4/1990 |
| WO | 9403373 | A1 | 2/1994 |
| WO | 9507066 | A1 | 3/1995 |
| WO | 9513785 | A1 | 5/1995 |
| WO | 9837854 | A1 | 9/1995 |
| WO | 9600053 | A1 | 1/1996 |
| WO | 9609083 | A1 | 3/1996 |
| WO | 9629113 | A1 | 9/1996 |
| WO | 9736636 | A1 | 10/1997 |
| WO | 9832411 | A1 | 7/1998 |
| WO | 9961093 | A1 | 12/1999 |
| WO | 0128490 | A1 | 4/2001 |
| WO | 0130425 | A1 | 5/2001 |
| WO | 0132524 | A1 | 5/2001 |
| WO | 0160311 | A1 | 8/2001 |
| WO | 0189607 | A2 | 11/2001 |
| WO | 0191693 | A2 | 12/2001 |
| WO | 0202165 | A2 | 1/2002 |
| WO | 200209797 | A1 | 2/2002 |
| WO | 0232372 | A1 | 4/2002 |
| WO | 0236191 | A2 | 5/2002 |
| WO | 0206610 | A2 | 8/2002 |
| WO | 02089900 | A1 | 11/2002 |
| WO | 03051423 | A2 | 6/2003 |
| WO | 03070147 | A2 | 8/2003 |
| WO | 03079956 | A1 | 10/2003 |
| WO | 2004041148 | A1 | 5/2004 |
| WO | 2004096113 | A2 | 11/2004 |
| WO | 2005002492 | A1 | 1/2005 |
| WO | 2005018703 | A2 | 3/2005 |
| WO | 2005041846 | A2 | 5/2005 |
| WO | 2005105014 | A2 | 11/2005 |
| WO | 2006099441 | A2 | 9/2006 |
| WO | 2007015233 | A1 | 2/2007 |
| WO | 2007017868 | A1 | 2/2007 |
| WO | 2007052252 | A1 | 5/2007 |
| WO | 2007/105221 | A1 | 9/2007 |
| WO | 2007101772 | A1 | 9/2007 |
| WO | 2008076459 | A1 | 6/2008 |
| WO | 2008081424 | A2 | 7/2008 |
| WO | 2008126090 | A1 | 10/2008 |
| WO | 2009026443 | A2 | 2/2009 |
| WO | 2009029010 | A1 | 3/2009 |
| WO | 2009038860 | A2 | 3/2009 |
| WO | 2009040804 | A2 | 4/2009 |
| WO | 2009087572 | A1 | 7/2009 |
| WO | 2009093249 | A1 | 7/2009 |
| WO | 2009112489 | A1 | 9/2009 |
| WO | 2009146088 | A1 | 12/2009 |
| WO | 2010061743 | A1 | 6/2010 |
| WO | 2010078227 | A1 | 7/2010 |
| WO | 2010117580 | A1 | 10/2010 |
| WO | 2011/004360 | A1 | 1/2011 |
| WO | 2011039747 | A1 | 4/2011 |
| WO | 2011058545 | A1 | 5/2011 |
| WO | 2011058548 | A1 | 5/2011 |
| WO | 2011077434 | A1 | 6/2011 |
| WO | 2011090955 | A1 | 7/2011 |
| WO | 2011104711 | A1 | 9/2011 |
| WO | 2011156373 | A1 | 12/2011 |
| WO | 2012/004790 | A2 | 1/2012 |
| WO | 2012004784 | A1 | 1/2012 |
| WO | 2012063230 | A1 | 5/2012 |
| WO | 2012143921 | A1 | 10/2012 |
| WO | 2012150587 | A1 | 11/2012 |
| WO | 2013127813 | A1 | 9/2013 |
| WO | 2013134246 | A1 | 9/2013 |
| WO | 2013148435 | A1 | 10/2013 |
| WO | 2013156944 | A1 | 10/2013 |
| WO | 2013156994 | A1 | 10/2013 |
| WO | 2014033706 | A2 | 3/2014 |
| WO | 2014033710 | A1 | 3/2014 |
| WO | 2014099395 | A1 | 6/2014 |
| WO | 2014170888 | A1 | 10/2014 |
| WO | 2014174278 | A1 | 10/2014 |
| WO | 2016023590 | A1 | 2/2016 |

OTHER PUBLICATIONS

Smart Site.RTM. Alaris Medical Systems Product Brochure, 4 pages, Issue 1, Oct. 1999.

MixJect, downloaded from webpage: http://www.westpharma.com/en/products/Pages/Mixject.aspx, Download Date: Aug. 8, 2012, 1 page.

MixJet Product Information Sheet, downloaded from webpage: http://www.westpharma.com/SiteCollectionDocuments/Recon/mixject%20product%20sheet.pdf; 1 page.

Silicone Rubber Overview Downloaded from webpage: http://www.knovel.com/web/portal/browse/display?_EXT_KNOVEL_DISPLAY_bookid=1023&VerticalID=0 on Feb. 9, 2011, Download Date: Sep. 2, 2011, Original Posting Date: 2010, 6 pages.

Alaris Medical Systems Product Brochure, 4 pages, Issue 1, Oct. 11, 1999.

Smart Site Needle-Free Systems, Alaris Medical Systems Webpage, 4 pages, Feb. 2006.

Photographs of Alaris Medical Systems SmartSite.RTM. device, 5 pages, 2002.

Non-Vented Vial Access Pin with ULTRASITE.RTM. Valve, B. Braun Medical, Inc. website and product description, 3 pages, Feb. 2006.

IV disposables sets catalogue, Cardinal Health, Alaris® products, SmartSite® access devices and accessories product No. 10013365, SmartSite add-on bag access device with spike adapter and needle-free valve bag access port, pp. 1-5, Fall edition (2007).

Article with picture of West Pharmaceutical Services' Vial2Bag Needleless System, [on-line]; ISIPS Newsletter, Oct. 26, 2007]; retrieved from Internet Feb. 16, 2010]; URL:<http://www.isips.org/reports/ISIPS_Newsletter_October_26_2007. html.> (7 pages. see pp. 5-6).

Int'l Preliminary Report on Patentability dated Jun. 5, 2018 in Int'l Application No. PCT/IL2017/050514.

Grifols Vial Adapter Product Literature, 2 pages, Jan. 2002.

* cited by examiner

DUAL VIAL ADAPTER ASSEMBLAGES INCLUDING IDENTICAL TWIN VIAL ADAPTERS

CROSS-REFERENCE TO RELATED APPLICATIONS

This application is a Section 371 of International Application No. PCT/IL2017/050514, filed May 10, 2017, which was published in the English language on Nov. 30, 2017, under International Publication No. WO 2017/203511 A1, which claims priority under 35 U.S.C. § 119(b) to Israeli Application No. 245800, filed May 24, 2016, the disclosures of each of which are incorporated herein by reference.

FIELD OF THE INVENTION

The invention relates to dual vial adapter assemblages for use with a drug vial containing a medicament and a liquid vial containing liquid contents.

BACKGROUND OF THE INVENTION

Dual vial adapter assemblages for use with a drug vial containing a medicament and a liquid vial containing liquid contents for mixing with or reconstituting the medicament in the drug vial to form a liquid drug include one vial adapter for telescopic mounting on the liquid vial for puncturing same and another vial adapter for telescopic mounting on the drug vial for puncturing same. Dual vial adapter assemblages can be generally classified into two types as follows: A negative pressure type intended to be used with a drug vial under negative pressure for positively drawing liquid contents from a liquid vial thereinto. A gravitational flow type employing a gravitational flow of liquid contents from a liquid vial to a drug vial. The former type is generally intended for preparing a small liquid drug dosage and the latter type is generally intended for preparing a large liquid drug volume suitable for several liquid drug dosages or use with an IV set for infusion.

One exemplary negative pressure type of dual vial adapter assemblage is disclosed in commonly owned U.S. Pat. No. 6,558,365 to Zinger et al. entitled Fluid Transfer Device including two vial adapters having a highly similar resemblance but differing insofar as one vial adapter has a male connector and the other vial adapter has a female connector. The male connector is preferably a male Luer lock connector and the female connector is preferably a female Luer connector with a screw thread for screw thread attachment of a male Luer lock connector thereon. Such dual vial adapter assemblages are commercially available from West Pharmaceutical Services, Inc., Exton, USA under the registered trademark MIX2VIAL.

According to the Instructions For Use (IFU) of the Zinger dual vial adapter assemblage, the vial adapter with the male connector is intended for telescopically mounting on a liquid vial and the vial adapter with the female connector is intended for telescopically mounting on a drug vial. The use of the Zinger dual vial adapter assemblage is as follows: First, a user initially telescopically mounts the vial adapter with the male connector on a liquid vial and only thereafter telescopically mounts the vial adapter with the female connector on a drug vial otherwise negative pressure is lost in the drug vial thereby preventing positive drawing of liquid contents from a liquid vial thereinto. Second, after the positive drawing of liquid contents from the liquid vial into the drug vial, the user detaches the vial adapter with the male connector and the now empty liquid vial from the vial adapter with the female connector mounted on the drug vial now containing liquid drug contents. And finally, the user connects a needleless syringe to the vial adapter with the female connector and aspirates the liquid contents from the drug vial thereinto.

However, in the case a user inadvertently confuses between the two vial adapters, and initially telescopically mounts the vial adapter with a female connector on the liquid vial and subsequently telescopically mounts the vial adapter with the male connector on the drug vial, the drug vial still positively draws the liquid contents from the liquid vial thereinto but the liquid drug is formed in the vial adapter with the male connector and not the female connector as per the IFU. Consequently, on detachment of the vial adapter with the now empty liquid vial from the vial adapter mounted on the drug vial containing the liquid drug, the vial adapter precludes direct attachment of a needleless syringe with its male connector thereonto for aspiration purposes.

One exemplary gravitational flow type of dual vial adapter assemblage is disclosed in commonly owned U.S. Pat. No. 8,752,598 to Denenburg et al. entitled Liquid Drug Transfer Assembly. US Pat. No. '598 FIG. 9 shows a dual vial adapter assemblage including two vial adapters having a highly similar resemblance but differing insofar one vial adapter has a female connector and the other vial adapter has a dual lumen dual ended liquid transfer spike for puncturing both a liquid vial stopper and a drug vial stopper. The Denenburg dual vial adapter assemblage advantageously does not require a specific order of telescopic mounting on a liquid vial and a drug vial by virtue of gravitational flow but in a similar manner to the Zinger dual vial adapter assemblage, a user still has to correctly distinguish between the two different types of vial adapter otherwise the liquid drug can be formed in the vial adapter with the male connector precluding attachment of a needleless syringe with its male Luer lock connector.

There is a need for dual vial adapter assemblages precluding the need for a user to distinguish between two types of vial adapters with a high degree of resemblance.

SUMMARY OF THE INVENTION

The present invention is directed towards dual vial adapter assemblages having a triple component construction as follows: First, a first vial adapter having a longitudinal first vial adapter centerline and including a transverse vial adapter top wall with an upright first vial adapter connector of a first connector type, an oppositely directed first vial adapter skirt for telescopic mounting on a drug vial, and a first vial stopper puncturing cannula for puncturing a drug vial stopper on telescopic mounting of the first vial adapter on a drug vial. Second, a second vial adapter having a longitudinal second vial adapter centerline and including a transverse second vial adapter top wall with an upright second vial adapter connector of the first connector type, an oppositely directed second vial adapter skirt for telescopic mounting on a liquid vial, and a second vial stopper puncturing cannula for puncturing a liquid vial stopper on telescopic mounting of the second vial adapter on a liquid vial. And third, a dual ended liquid transfer coupler interdisposed between the first vial adapter and the second vial adapter and having a pair of opposite coupler ends in the form of twin connectors of a second connector type for sealed engagement with the first vial adapter connector and the second vial adapter connector in a set-up position of the dual vial adapter assemblage such that the first vial adapter connector is in flow communication with the second vial adapter connector.

The identical twin vial adapters are preferably provided with a female Luer connector and the dual ended liquid transfer coupler is correspondingly provided with twin male Luer lock connectors. Alternatively, the identical twin vial adapters can be provided with a male Luer lock connector and the dual ended liquid transfer coupler is correspondingly provided with twin female Luer connectors.

The dual vial adapter assemblages of the present invention can be designed to be of the negative pressure type or the gravitational flow type. In the latter case, the first vial adapter and the second vial adapter are both of the vented type and each includes a dual lumen vial stopper puncturing member having a liquid lumen in flow communication with its respective vial adapter connector and a vented air lumen. The dual vial adapter assemblages of the present invention are preferably provided in a set-up position ready for immediate use on removal from suitable sterile packaging. Alternatively, the dual vial adapter assemblages may require to be assembled by a user before use.

The dual vial adapter assemblages of the present invention intended for preparing a large volume of liquid drug for infusion purposes preferably include vial adapters designed for quick release from a vial as disclosed in PCT International Publication No. WO 2012/150587 entitled Vial Adaptor. Accordingly, a vial adapter can be readily removed from a drug vial containing a liquid drug thereby exposing its drug vial stopper for insertion of an IV set for infusion of the liquid drug to a patient.

BRIEF DESCRIPTION OF DRAWINGS

In order to understand the invention and to see how it can be carried out in practice, preferred embodiments will now be described, by way of non-limiting examples only, with reference to the accompanying drawings in which similar parts are likewise numbered, and in which.

DETAILED DESCRIPTION OF PREFERRED EMBODIMENTS OF THE INVENTION

Figure 1:
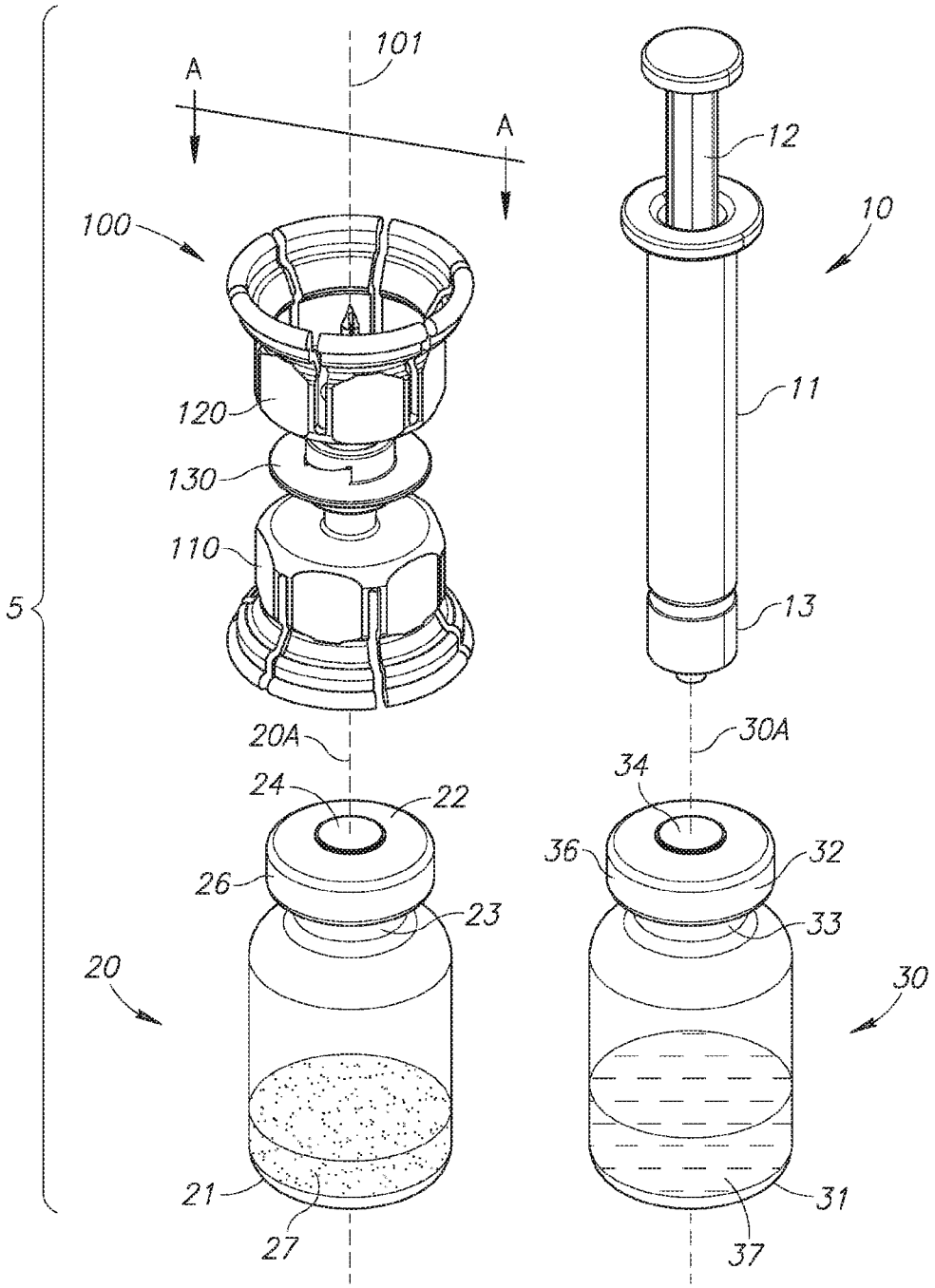
FIG. 1 is a pictorial view of an administration set including a needleless syringe, a drug vial, a liquid vial, and a dual vial adapter assemblage in accordance with a first preferred embodiment of the present invention.

FIG. 1 shows an administration set 5 including an initially empty needleless syringe 10, a drug vial 20, a liquid vial 30 and a dual vial adapter assemblage 100 of the negative pressure type for preparing a small liquid drug dosage for aspiration into the needleless syringe 10 for administration purposes. The needleless syringe 10 includes a barrel 11 with a plunger 12 and a male Luer lock connector 13. The syringe 10 can be formed with other types of male connectors. The drug vial 20 has a longitudinal drug vial axis 20A and includes an open topped drug vial bottle 21 having a drug vial crown 22 and a narrow diameter drug vial neck 23. The drug vial crown 22 is sealed by a drug vial stopper 24. The drug vial stopper 24 is sealed by an aluminum band 26. The drug vial 20 contains a medicament 27 in the form of a powder, solid or liquid. The liquid vial 30 has a longitudinal liquid vial axis 30A and includes an open topped liquid vial bottle 31 having a liquid vial crown 32 and a narrow diameter drug vial neck 33. The liquid vial crown 32 is sealed by a liquid vial stopper 34. The liquid vial stopper 34 is sealed by an aluminum band 36. The liquid vial 30 includes liquid contents 37 in the form of diluent only or an active component.

Figure 2:
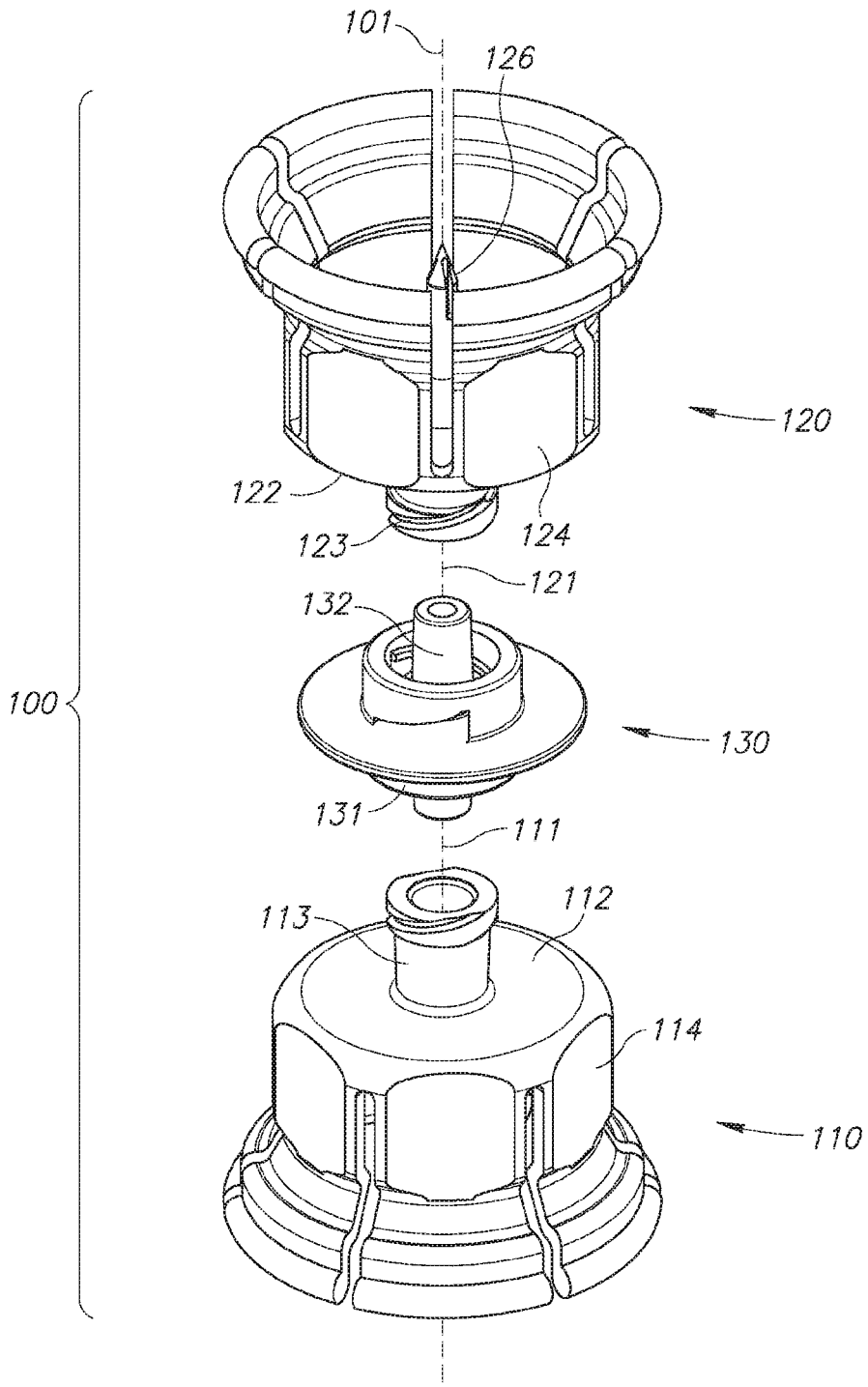
FIG. 2 is an exploded view of the FIG. 1 dual vial adapter assemblage.
Figure 3:
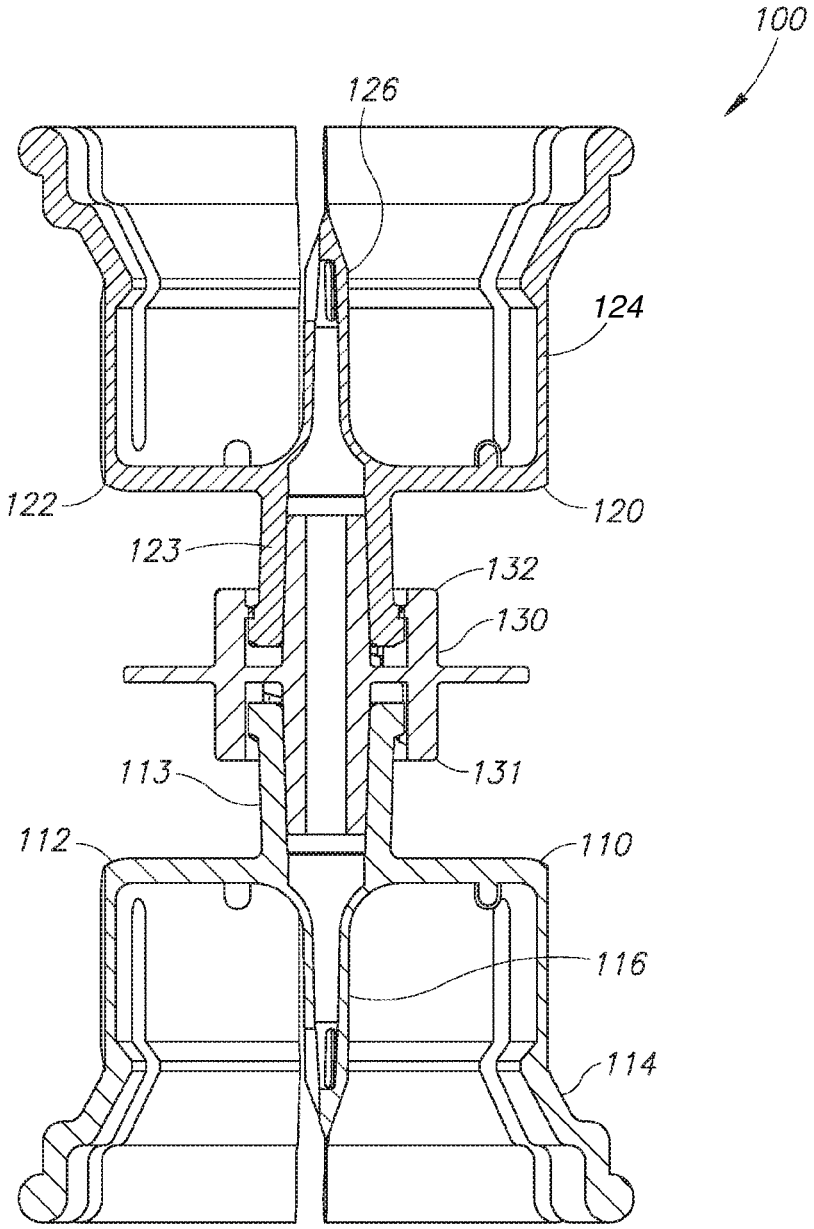
FIG. 3 is a longitudinal cross section of the FIG. 1 dual vial adapter assemblage along line A-A in FIG. 1.

FIGS. 2 and 3 show the dual vial adapter assemblage 100 has a longitudinal dual vial adapter assemblage centerline 101 and includes a first vial adapter 110, a second vial adapter 120 and a dual ended liquid transfer coupler 130 interdisposed between the first vial adapter 110 and the second vial adapter 120 in a set-up position of the dual vial adapter assemblage 100.

The first vial adapter 110 has a longitudinal first vial adapter centerline 111 and includes a transverse first vial adapter top wall 112. The first vial adapter top wall 112 has an upright first vial adapter connector 113 of a first connector type constituted by a female Luer connector including an external screw thread for screw thread engagement by a male Luer lock connector. The first vial adapter top wall 112 has an oppositely directed first vial adapter skirt 114 for telescopic mounting on a drug vial or a liquid vial. The first vial adapter top wall 112 includes a first vial stopper puncturing cannula 116 for puncturing a vial stopper on telescopic mounting of the first vial adapter 110 on a vial. The first vial stopper puncturing cannula 116 is in flow communication with the first vial adapter connector 113.

The second vial adapter 120 has a longitudinal second vial adapter centerline 121 and includes a transverse second vial adapter top wall 122. The second vial adapter top wall 122 has an upright second vial adapter connector 123 of the same connector type as the first vial adapter connector 113. The second vial adapter top wall 122 has an oppositely directed second vial adapter skirt 124 for telescopic mounting on a drug vial or a liquid vial. The second vial adapter top wall 122 includes a second vial stopper puncturing cannula 126 for puncturing a vial stopper on telescopic mounting of the second vial adapter 120 on a vial. The second vial stopper puncturing cannula 126 is in flow communication with the second vial adapter connector 123.

The dual ended liquid transfer coupler 130 is formed with dual opposite connectors 131 and 132 of a second connector type for corresponding sealing engagement with the first vial adapter connector 113 and the second vial adapter connector 123 in the set-up position of the dual vial adapter assemblage 100. Accordingly, the dual opposite connectors 131 and 132 are constituted by male Luer lock connectors for corresponding sealing engagement on the female Luer connector 113 and the female Luer connector 123.

Figure 4A:
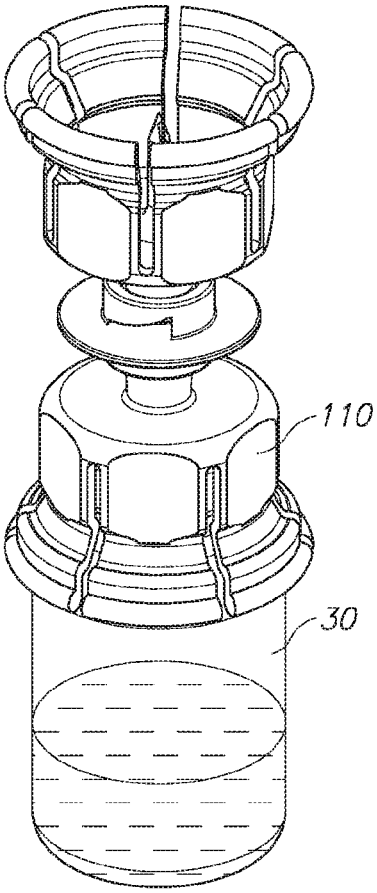
FIG. 4A to FIG. 4D show the use of the administration set.
Figure 4B:
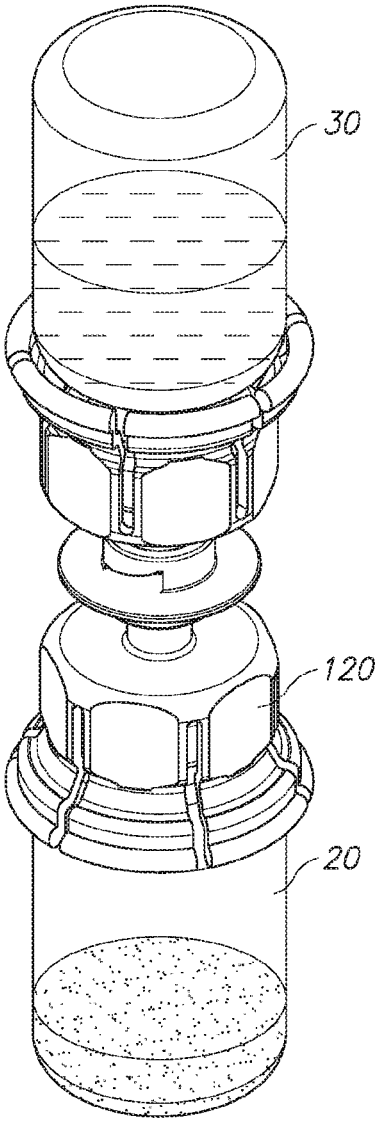
Figure 4C:
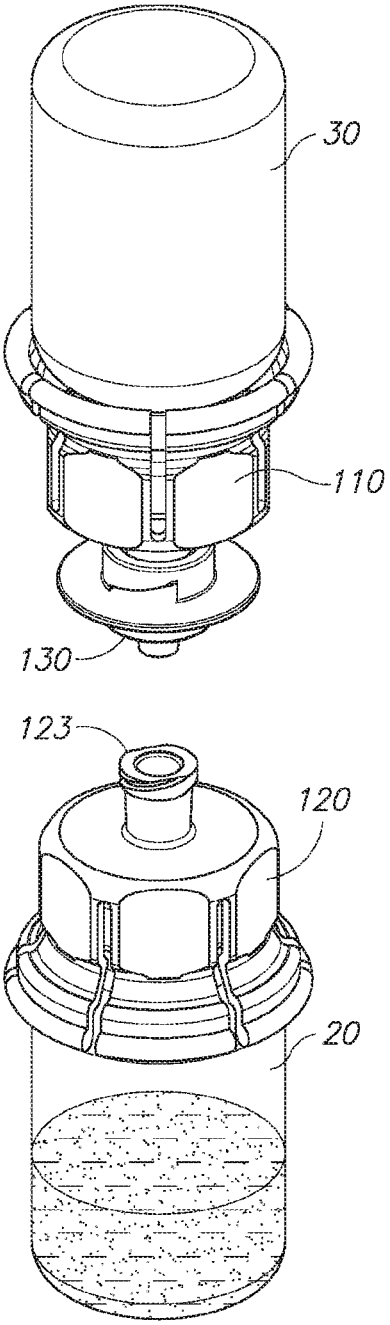
Figure 4D:
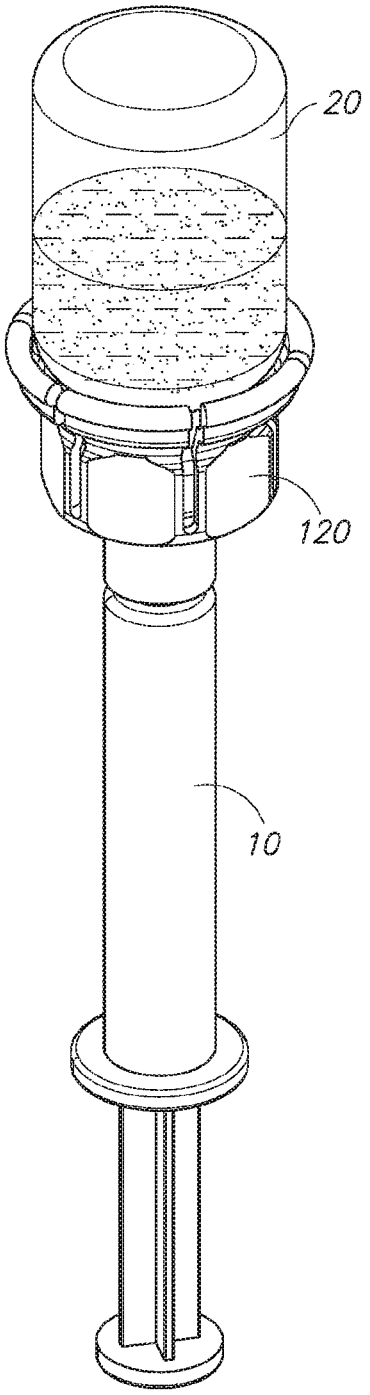

FIGS. 4A to 4D show the use of the administration set 5 for preparing a liquid drug in a drug vial 20 ready for administration to a patient as follows:

FIG. 4A shows the telescopic mounting of the first vial adapter 110 on the liquid vial 30 for puncturing same. FIG. 4B shows inverting the dual vial adapter assemblage 100 together with the attached liquid vial 30 and mounting the second vial adapter 120 on the drug vial 20 for puncturing same thereby leading to positive drawing of liquid contents from the liquid vial 30 to the drug vial 20 to form a liquid drug therein. FIG. 4C shows unscrewing the dual ended liquid transfer coupler 130 from the second vial adapter 120 for exposing the female Luer connector 123. FIG. 4D shows screwing the syringe 10 onto the second vial adapter 120 for aspirating a liquid drug dosage from the drug vial 20 for administration to a patient. Alternatively, FIG. 4A to FIG. 4D could equally show telescopic mounting of the second vial adapter 120 on the liquid vial 30, the first vial adapter 110 on the drug vial 20, unscrewing the dual ended liquid transfer coupler 130 from the first vial adapter 110 for exposing the female Luer connector 113 and screwing the syringe 10 onto the first vial adapter 110 for aspirating a liquid drug dosage from the drug vial 20 for administration to a patient.

Figure 5:
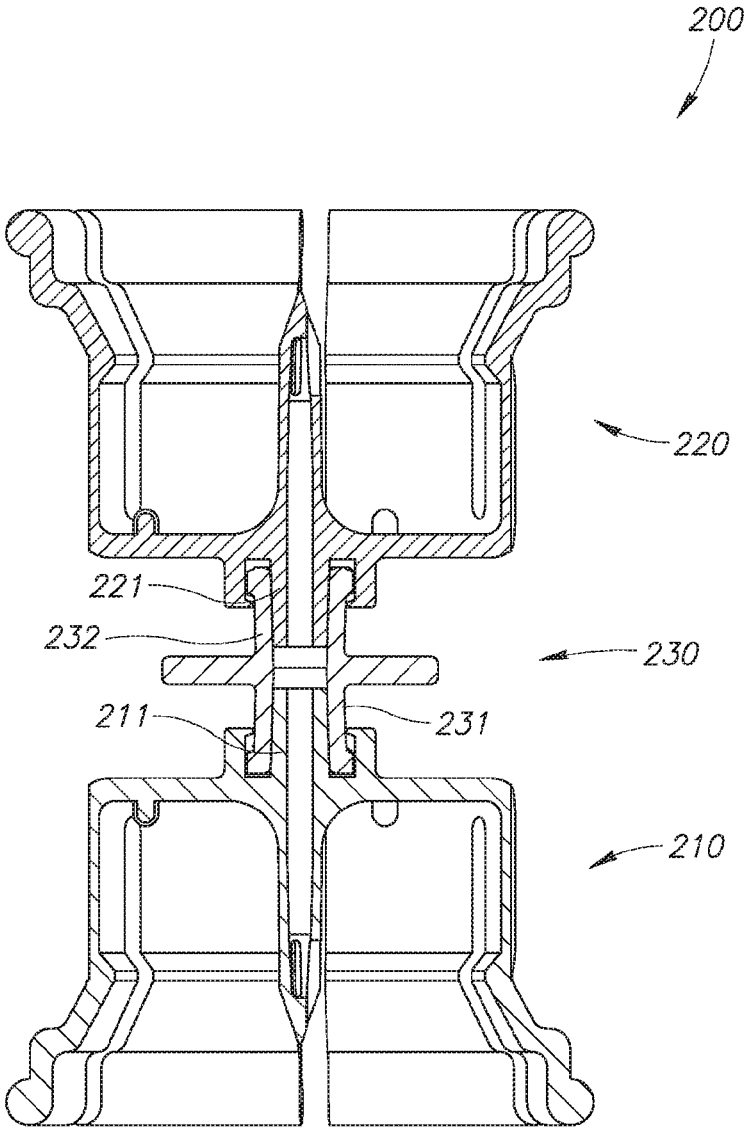
FIG. 5 is a longitudinal cross section of a dual vial adapter assemblage in accordance with a second preferred embodiment of the present invention.

FIG. 5 shows a dual vial adapter assemblage 200 similar in construction and operation as the dual vial adapter assemblage 100. The latter 200 differs from the former 100 insofar as the latter 200 includes a first vial adapter 210 having an upright first vial adapter connector 211 of a first connector type, a second vial adapter 220 having an upright second vial adapter connector 221 of the same first connector type and a dual ended liquid transfer coupler 230 having dual opposite connectors 231 and 232 of the second connector type for corresponding sealing engagement with the first vial adapter connector 211 and the second vial adapter connector 221 in a set-up position of the dual vial adapter assemblage 200. The first connector type is constituted by a male Luer lock connector and the second connector type is constituted by a female Luer connector. The use of the dual vial adapter assemblage 200 is the same as the dual vial adapter assemblage 100 except that the dual ended liquid transfer coupler 230 is left attached to either the first vial adapter 210 or the second vial adapter 220 telescopically mounted on a drug vial 20 containing a liquid drug formed therein.

Figure 6:
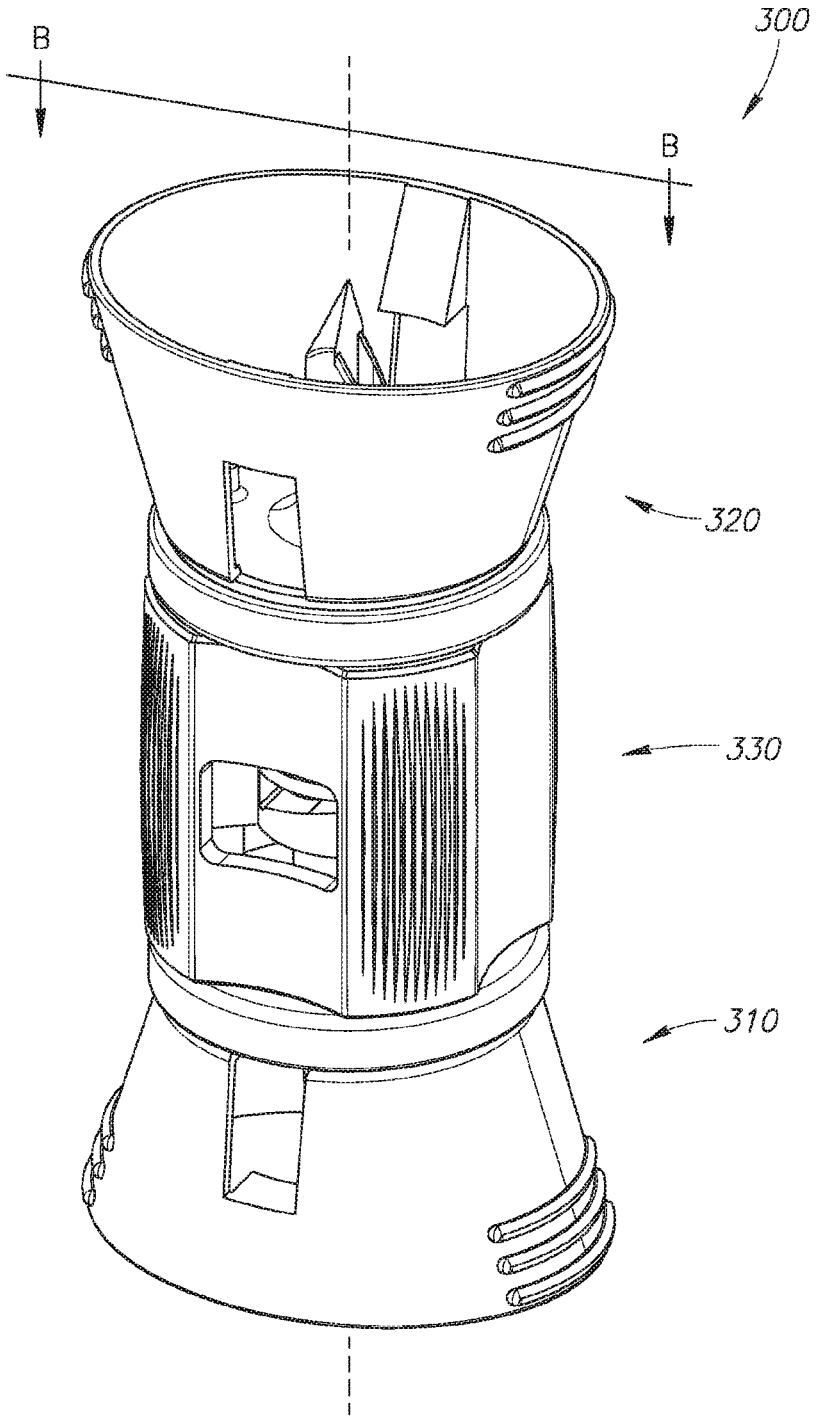
FIG. 6 is a perspective view of a dual vial adapter assemblage in accordance with a third preferred embodiment of the present invention.
Figure 7:
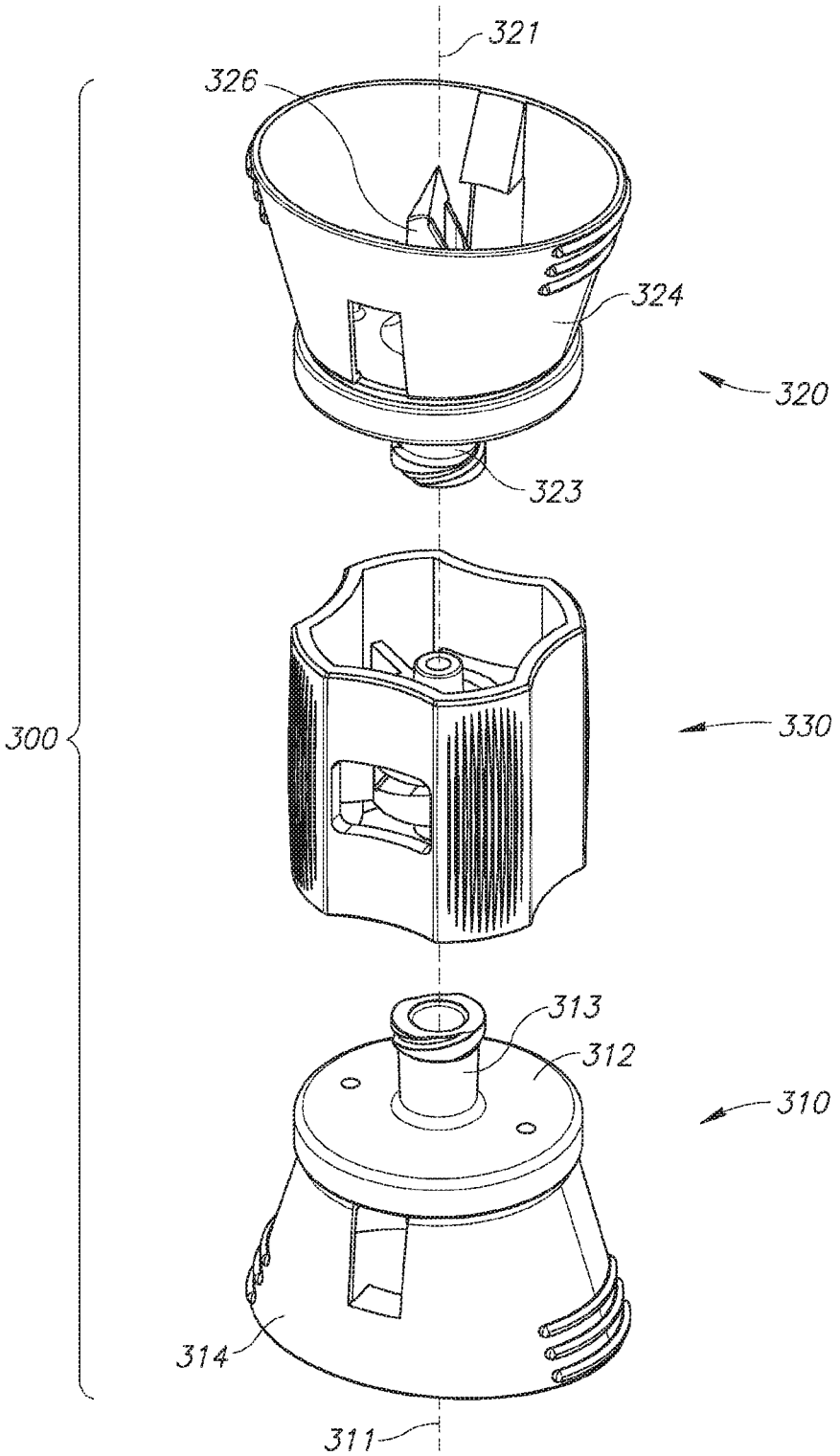
FIG. 7 is an exploded view of the FIG. 6 dual vial adapter assemblage.
Figure 8:
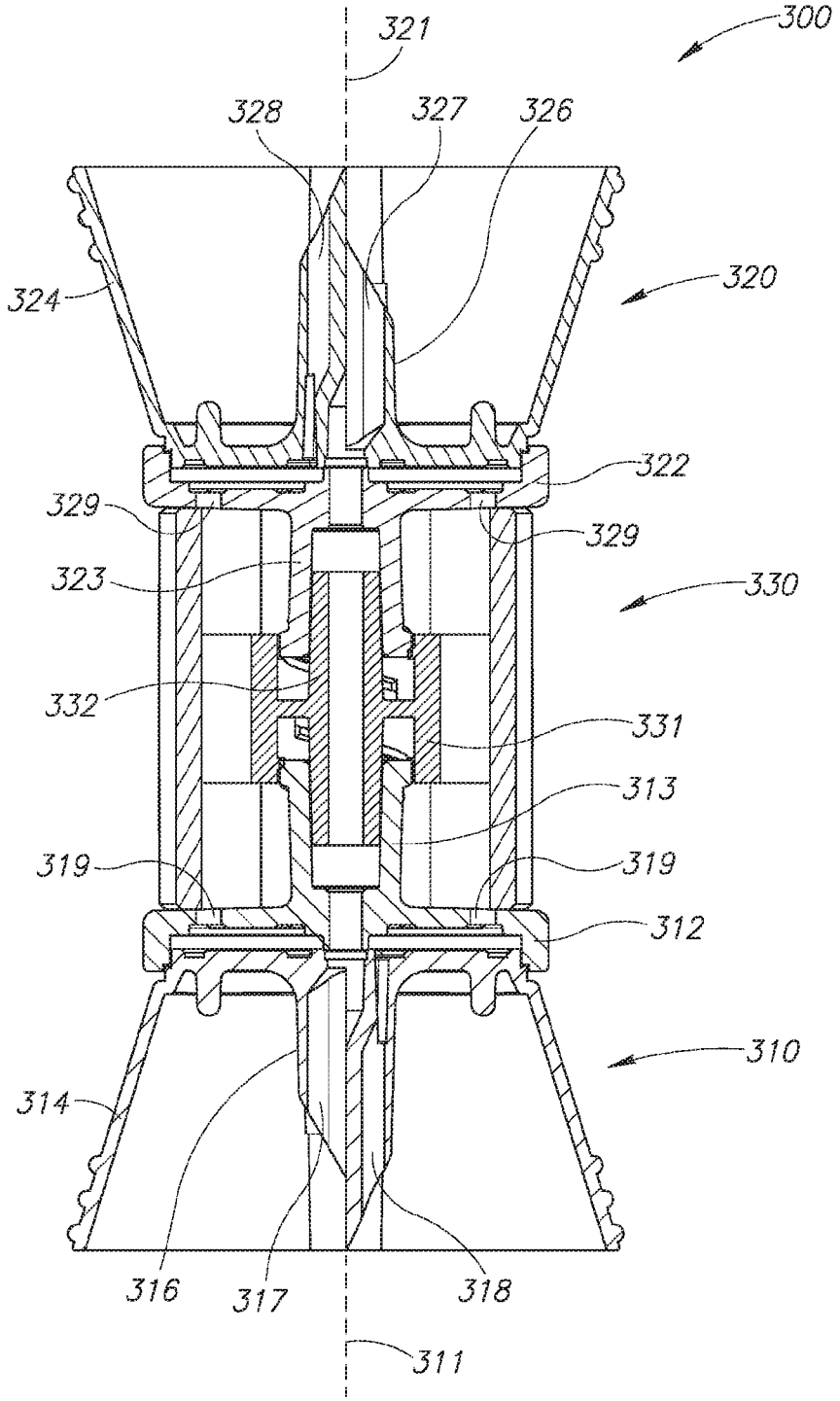
FIG. 8 is a longitudinal cross section of the FIG. 6 dual vial adapter assemblage along line B-B in FIG. 6.

FIGS. 6 to 8 show a dual vial adapter assemblage 300 of the gravitational flow type for preparing a large liquid drug dosage. The dual vial adapter assemblage 300 includes a first vial adapter 310, a second vial adapter 320 and a dual ended liquid transfer coupler 330 intermediate the first vial adapter 310 and the second vial adapter 320. The first vial adapter 310 and the second vial adapter 320 are preferably of the quick release type as disclosed in PCT International Publication No. WO 2012/150587 entitled Vial Adaptor.

The first vial adapter 310 has a longitudinal first vial adapter centerline 311 and includes a transverse first vial adapter top wall 312 having an upright female Luer connector 313 with an external screw thread for screw thread engagement by a male Luer lock connector. The first vial adapter top wall 312 has an oppositely directed first vial adapter skirt 314 for telescopic mounting on a vial. The first vial adapter top wall 312 includes a dual lumen vial stopper puncturing cannula 316 for puncturing a vial stopper on telescopic mounting of the first vial adapter 310 on a vial. The dual lumen vial stopper puncturing cannula 316 includes a liquid lumen 317 in flow communication with the female Luer connector 313 and a vented air lumen 318 with throughgoing bores 319 formed in the first vial adapter top wall 312. The liquid lumen 317 typically has a wider lumen diameter than the vented air lumen 318. The vial adapter 310 can optionally include an air filter for filtering incoming air.

The second vial adapter 320 has a longitudinal second vial adapter centerline 321 and includes a transverse second vial adapter top wall 322. The second vial adapter top wall 322 has an upright female Luer connector 323 for screw thread engagement by a male Luer lock connector. The second vial adapter top wall 322 has an oppositely directed second vial adapter skirt 324 for telescopic mounting on a vial. The second vial adapter top wall 322 includes a dual lumen vial stopper puncturing cannula 326 for puncturing a vial stopper on telescopic mounting of the second vial adapter 320 on a vial. The dual lumen vial stopper puncturing cannula 326 includes a liquid lumen 327 in flow communication with the female Luer connector 323 and a vented air lumen 328 with throughgoing bores 329 formed in the second vial adapter top wall 322. The liquid lumen 327 typically has a wider lumen diameter than the vented air lumen 328. The vial adapter 320 can optionally include an air filter for filtering incoming air.

The dual ended liquid transfer coupler 330 includes dual opposite male Luer lock connectors 331 and 332 for corresponding sealing engagement with the female Luer connector 313 and the female Luer connector 323 in the set-up position of the dual vial adapter assemblage 300.

Figure 9:
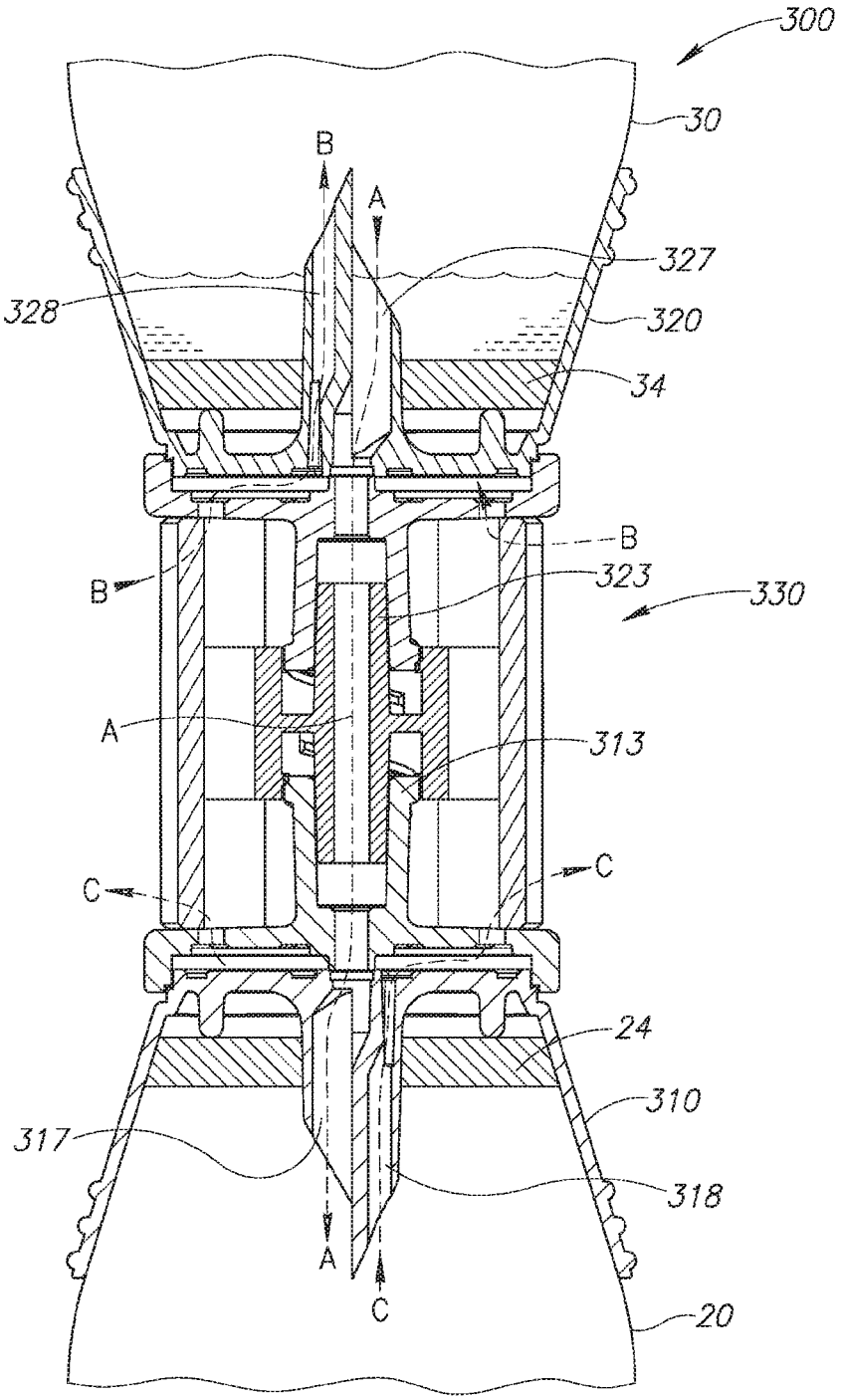
FIG. 9 is a longitudinal cross section of the FIG. 6 dual vial adapter assemblage along line B-B in FIG. 6 showing transfer of liquid contents from a liquid vial to a drug vial.

FIG. 9 shows the first vial adapter 310 telescopic mounted on the drug vial 20 and the second vial adapter 320 telescopic mounted on the liquid vial 30. Alternatively, the telescopic mounting of the dual vial adapter assemblage 300 on the drug vial 20 and the liquid vial 30 could have been reversed with the first vial adapter 310 telescopic mounted on the liquid vial 30 and the second vial adapter 320 mounted on the drug vial 20. FIG. 9 shows gravitational flow of liquid contents from the liquid vial 30 to the drug vial 20 through the liquid lumen 327, the dual ended liquid transfer coupler 330 and the liquid lumen 317 as denoted by arrows A. FIG. 9 shows the gravitational flow is facilitated by air being drawn into the liquid vial 30 via the vented air lumen 328 denoted by arrows B and air being expelled from the drug vial 20 via the vented air lumen 318 denoted by the arrows C.

The use of dual vial adapter assemblage 300 is similar to the dual vial adapter assemblage 100 except the dual ended liquid transfer coupler 330 is unscrewed from the first vial adapter 310 ready for attachment of the needleless syringe 10 for aspiration of some liquid drug from the drug vial 20. Thereafter, the second vial adapter 310 is removed from the drug vial 20 for exposing the drug vial stopper 24 for administration by an IV infusion set.

Figure 10:
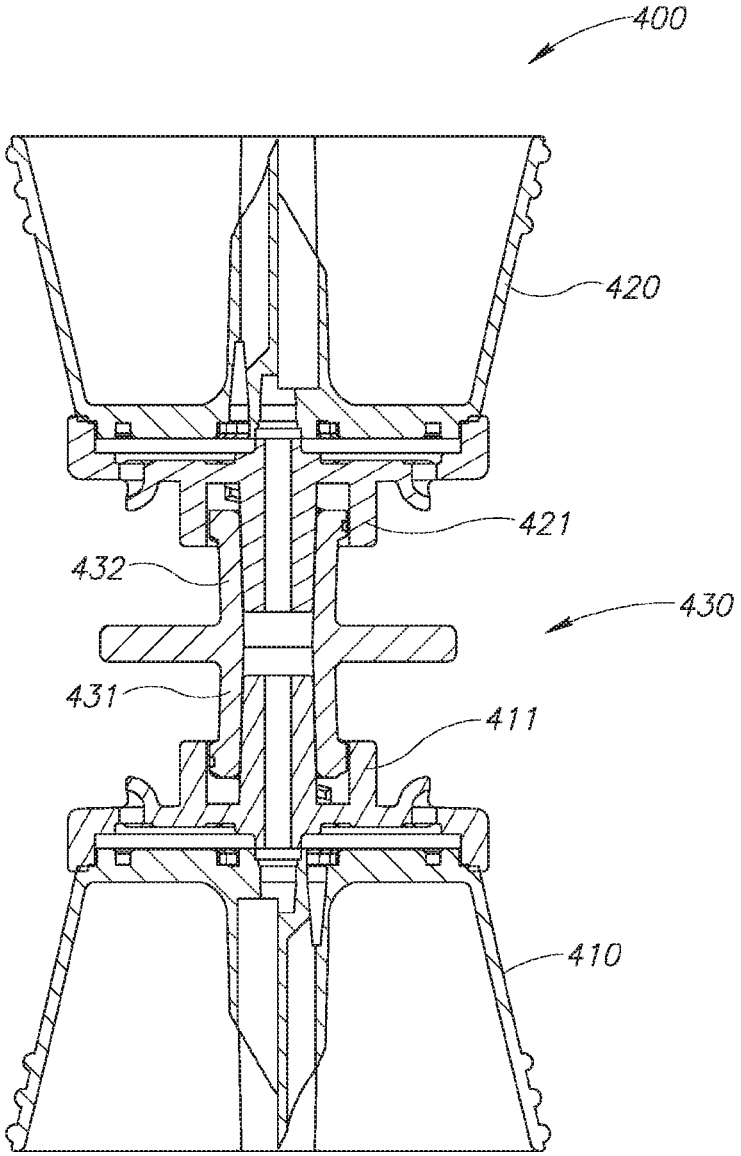
FIG. 10 is a longitudinal cross section of a dual vial adapter assemblage in accordance with a fourth preferred embodiment of the present invention.

FIG. 10 shows a dual vial adapter assemblage 400 similar in construction and operation as the dual vial adapter assemblage 300. The latter 400 differs from the former 300 insofar as the latter 400 include a first vial adapter 410 having a male Luer lock connector 411, a second vial adapter 420 having a male Luer lock connector 421 and a dual ended liquid transfer coupler 430 having dual opposite female Luer connectors 431 and 432 for corresponding sealing engagement with the male Luer lock connector 411 and the male Luer lock connector 421. The use of the dual vial adapter assemblage 400 is the same as the dual vial adapter assemblage 300 except that the dual ended liquid transfer coupler 430 is left attached to either the first vial adapter 410 or the second vial adapter 420 telescopically mounted on a drug vial 20 containing a liquid drug formed therein.

While particular embodiments of the present invention are illustrated and described, it would be obvious to those skilled in the art that various other changes and modifications can be made without departing from the spirit and scope of the invention.

The invention claimed is:

1. A dual vial adapter assemblage for use with a drug vial and a liquid vial, the drug vial having a drug vial bottle and a drug vial stopper sealing the drug vial bottle, the drug vial containing a medicament, the liquid vial having a liquid vial bottle and a liquid vial stopper sealing the liquid vial bottle, the liquid vial containing liquid contents for mixing with or reconstituting the medicament in the drug vial to form a liquid drug therein, a needleless syringe having a male connector, the dual vial adapter assemblage having a longitudinal dual vial adapter assemblage centerline and comprising:

(a) an integrally formed first vial adapter having a longitudinal first vial adapter centerline and including a transverse vial adapter top wall with an upright first vial adapter connector of a first connector type, an oppositely directed first vial adapter skirt for telescopic mounting on the drug vial, and a first vial stopper puncturing cannula for puncturing the drug vial stopper on said telescopic mounting of said first vial adapter on the drug vial;

(b) an integrally formed second vial adapter having a longitudinal second vial adapter centerline and including a transverse second vial adapter top wall with an upright second vial adapter connector of said first connector type, an oppositely directed second vial adapter skirt for telescopic mounting on the liquid vial, and a second vial stopper puncturing cannula for puncturing the liquid vial stopper on said telescopic mounting of said second vial adapter on the liquid vial; and (c) a dual ended liquid transfer coupler having a pair of opposite coupler ends in the form of twin connectors of a second connector type for sealed engagement with said first vial adapter connector and said second vial adapter connector in a set-up position of the dual vial adapter assemblage such that said first vial adapter connector is in flow communication with said second vial adapter connector for forming the liquid drug in the drug vial, wherein one connector type of said first connector type and said second connector type is a female connector for sealed engagement with the needleless syringe's male connector and the other connector type of said first connector type and said second connector type is a male lock connector for screw thread sealed engagement with said female connector, the arrangement being such that, in use, for aspiration of the liquid drug from the drug vial, when said first vial adapter connector is configured as a female connector, the needleless syringe is directly attachable to said first vial adapter connector, and when said first vial adapter connector is configured as a male connector, the needleless syringe is directly attachable to said dual ended liquid transfer coupler attached to said first vial adapter connector.

2. The assemblage according to claim 1 wherein said first vial stopper puncturing cannula includes i) a liquid lumen in flow communication with said first vial adapter connector and ii) a vented air lumen and said second vial stopper puncturing cannula includes i) a liquid lumen in flow communication with said second vial adapter connector and ii) a vented air lumen.

3. The assemblage according to claim 1 wherein said first connector type is a female Luer connector and said second connector type is a male Luer lock connector.

4. The assemblage according to claim 1 wherein said first connector type is a male Luer lock connector and said second connector type is a female Luer connector.

* * * * *